US005517218A

United States Patent [19]

Lehna et al.

[11] Patent Number: 5,517,218

[45] Date of Patent: May 14, 1996

[54] INK PRINTER WITH A CLEANING AND SEALING STATION

[75] Inventors: Heinz Lehna, Rosenheim; Peter Kuelzer, Wessling/Hochstadt, both of Germany

[73] Assignee: Eastman Kodak Company, Rochester, N.Y.

[21] Appl. No.: 911,200

[22] Filed: Jul. 9, 1992

Related U.S. Application Data

[63] Continuation-in-part of PCT/DE90/00940, Dec. 4, 1990.

[30] Foreign Application Priority Data

Jan. 9, 1990 [DE] Germany ..... 40 00 453.8

[51] Int. Cl.[6] ..... B41J 2/165

[52] U.S. Cl. ..... 347/24; 347/30

[58] Field of Search ..... 346/1.1, 75, 190 R; 347/22, 23, 29, 30, 31, 32; 347/24

[56] References Cited

U.S. PATENT DOCUMENTS 4,577,203 3/1986 Kawamura .
4,746,938 5/1988 Yamamori et al. .
4,825,231 4/1989 Nozaki .
4,853,717 8/1989 Harmon et al. .
5,086,305 2/1992 Terasawa ..... 346/140 RX
5,146,243 9/1992 English et al. ..... 346/140 R
5,166,708 11/1992 Hirano et al. ..... 346/140 R

FOREIGN PATENT DOCUMENTS 58-194554 11/1983 Japan ..... 346/140 R
63-188054 8/1988 Japan .

OTHER PUBLICATIONS

Patent Abstract of Japan, vol. 12, No. 464, (M–771) (3311), Dec. 6, 1988.

*Primary Examiner*—Benjamin R. Fuller
*Assistant Examiner*—John Barlow
*Attorney, Agent, or Firm*—Horst M. Kasper

[57] ABSTRACT

In order to avoid the ink drying up in the nozzle apertures of the print head (80) of an ink printer (1) during lengthy pauses in printing and to prevent the nozzle apertures from becoming dirty, the printer (1) described has a cleaning and sealing station (6). Designed as an independent unit, the cleaning and sealing station (6) is located in the overshoot region (OV) of the print head carriage (7). The fact that the carriage (7) no longer requires a separate service and parking position, enables the width of the printer (1) to be reduced.

34 Claims, 7 Drawing Sheets

61
34
33
81
8
a
a/2

INK PRINTER WITH A CLEANING AND SEALING STATION

CROSS-REFERENCE TO RELATED APPLICATIONS

This application is a continuation-in-part application of another international application filed under the Patent Cooperation Treaty Dec. 4, 1990, bearing Application No. PCT/DE90/00940, and listing the United States as a designated and/or elected country. The entire disclosure of this latter application, including the drawings thereof, is hereby incorporated in this application as if fully set forth herein.

BACKGROUND OF THE INVENTION

1. Field of the Invention

The present invention relates to an ink print device including at least one ink jet print head, disposed movable back and forth along a platen, and exhibiting a recording substrate and a cleaning and sealing station in a work region.

2. Brief Description of the Background of the Invention Including Prior Art

Ink jet printing devices are of increasing interest for the user based on the development of ever more powerful and increasingly higher capability microprocessors in addition to a plurality of other print devices such as, for example, pin printers, matrix printers, thermal transfer printers, thermal printers, thermographic printers and electrophotographic printers. The purchase of a printer is frequently a complex decision, where the production features such as speed, economy and print quality are in the foreground based on the increased capability of the peripheral text processing apparatus. The production feature, namely to be able to print in color, is furthermore of marked importance for various fields of application. For this purpose, ink printing presents optimum preconditions and prerequisites based on the use of color writing liquids, which can be produced at a low cost and in a simple manner, in addition to the thermal transfer printing process.

The ink colors employed for providing color to the writing liquids are, for example, yellow, cyan, magenta, and black according to the German printed patent document DE-A1 37 36 916. The ink in the nozzle exit or nozzle ejection openings of an ink jet print head can dry up in case of longer printing intervals. In order to prevent this drying, the ink jet print device exhibits, for example, a cleaning and sealing station or, respectively, a suction regeneration device. Cleaning and sealing stations can also be employed to eliminate soiling at the nozzle exit openings of the ink jet print head in the ink jet print device. For this purpose, the ink jet print heads are cleaned at regular time intervals and are sealed in case of longer printing intervals of the ink jet printing device. In case of use of cleaning and sealing stations in color printers, it has to be guaranteed that there does not occur a mixing of colors during the cleaning and sealing of the ink jet print heads.

A cleaning and sealing station or, respectively, a suction regeneration device for ink jet print heads in ink jet print devices is known in each case from the German printed patent document DE-A1-33 16 474, German printed patent document DE-A1-33 16 968, German printed patent document DE-A1-36 04 373, German printed patent document DE-A1 36 11 333, German printed patent document DE-A1-36 33 239, German printed patent document DE-A1-37 26 671, German printed patent document DE-A1-38 10 698, and European printed patent document EP-A1-0,094,220. Nozzle exit openings of the ink jet print heads are cleaned, flushed and the nozzle exit openings are sealed in case of longer printing intervals of the ink jet print devices in different ways with the cleaning and sealing station or, respectively, the suction regeneration device. The cleaning and sealing station or, respectively, suction regeneration device is disposed for this purpose preferably in a parking position outside the operating and working region of a printer carriage, supporting the ink jet print heads and disposed in the ink jet print device. The construction space, additionally required based on this arrangement, in the ink printer effects that, depending on the outer dimensioning of the cleaning and sealing station or, respectively, suction regeneration device, the ink jet print device becomes wider and thus more cumbersome to handle.

SUMMARY OF THE INVENTION

1. Purposes of the Invention

It is an object of the present invention to construct an ink jet print device with a cleaning and sealing station which is simple, low cost, and service friendly.

It is a further object of the present invention to keep the mounting space for the cleaning and sealing station as small as possible in the ink jet print device.

It is still a further object of the present invention to provide for a cleaning and sealing station which is a self-contained unit.

It is yet a further object of the present invention to provide for a cleaning and sealing station which can be used for different ink jet print devices.

These and other objects and advantages of the present invention will become evident from the description which follows.

2. Brief Description of the Invention

The present invention provides for an ink jet print device. A print support platen receives and supports a recording substrate. An ink jet print head is disposed movable back and forth parallel to and along a longitudinal direction of the print support platen. A cleaning and sealing station is disposed in a work region for engaging the ink jet print head. The work region includes a printing region, a first overshoot region, and a second overshoot region, thereby providing two overshoot regions. The first overshoot region and the second overshoot region are adjoining to the printing region. The first overshoot region and the second overshoot region serve for allowing to accelerate and to brake the back and forth movable ink jet print head. The cleaning and sealing station is disposed in one of the two overshoot regions.

The cleaning and sealing station can be constructed as a self-contained construction unit capable of being exchanged by withdrawing from and inserting into the ink jet print device.

A suction device can suction ink from the ink jet print head. A cover device can cover the ink jet print head. A support member can support the suction device and support the cover device and can be disposed at the cleaning and sealing station. The support member can be constructed and attached at the sealing and cleaning station swivelable toward the ink jet print head.

An adjustment device can be attached to the support member. The adjustment device can furnish the support member with adjustability of a position for setting a relative position of the support member with respect to the ink jet print head.

A printer carriage and the ink jet print head can form an ink jet print unit. The support member for the suction device and for the cover device can be movably supported by means of the adjustment device between two lateral relative positions of the ink jet print unit relative to the suction device and to the cover device.

A motor-driven cam disk can be disposed on the cleaning and sealing station for tilting the support member. Spring support means for maintaining the support member spring can be supported and rest at the cam disk.

A pivot drive can be disposed at the cleaning and sealing station for the support member. A pump can be coupled to the pivot drive for suctioning of the ink from the suction device and the cover device.

A running wheel can be coordinated to the support member. The motor-driven cam disk can include two cam paths. The two cam paths can be joining each other. The running wheel can be guided on the cam paths.

A switch tongue can be coordinated to and can be actuated by the cam disk. The switch tongue initiates a pumping of the ink or, respectively, a decoupling of the suction device and the cover device from the ink jet print unit based on controlling the circumferential path of the running wheel around the cam disk as a function of the direction of rotation of the motor-driven cam disk for the suction device and the cover device coupled to the ink jet print unit.

The suction device and the cover device can be furnished with an elastically formed insert cap with a liquid-absorbing liner for hermetically sealing the ink jet print head during the suctioning of the ink from the ink jet print head and for covering the ink jet print head.

The suction device and the cover device can comprise an elastic cap positionable against the ink jet print head. A pressure compensation channel can be connected to and coordinated to the insert cap for a pressure compensation in the insert cap and a suction channel can be coordinated to the insert cap for the withdrawal of the ink. The pressure compensation channel of the insert cap can be coupled to a pressure compensation device. The suction channel can join in a common withdrawal channel. The common withdrawal channel can be in connection with the suction device. A valve device can be connected to and coordinated to the suction channel for assuring a controlled withdrawal of ink from the insert cap.

The pressure compensation device can exhibit a common ventilation channel coupled to the pressure compensation channel. The common ventilation channel can have a controllable closure for the feeding of air as required depending on the operating position of the suction and cover device.

The pressure compensation device can be formed as a closed system relative to the ambient air, with a common pressure compensation chamber for the pressure compensation channel and a membrane film for closing the pressure compensation chamber relative to the ambient air.

The valve device, coordinated to the suction channel, can exhibit a capillary filter disposed in the suction channel. A suction pressure acting at the withdrawal channel can be selected such that, upon emptying the suction channel of ink, the capillary filter is only then overcome by inflowing ambient air through the suction channel when the suction channel no longer contains any ink.

The valve device coordinated to the suction channel can exhibit a one-way directional valve. The one-way directional valve can open in suction direction of the ink and can close in opposite direction to the suction direction of the ink.

The suction device and the cover device can comprise a second elastic rubber insert cap provided to be resting at a second ink jet print head. The number of rubber insert caps can correspond to the number of ink jet print heads. A second pressure compensation channel can be coordinated to and connected to the second rubber insert cap for furnishing a pressure compensation in the second rubber insert cap. The pressure compensation device can be coupled and connected to the second pressure compensation channel of the second rubber insert cap. A second suction channel can be coordinated to and connected to the second rubber insert cap for allowing a withdrawal of ink. The common withdrawal channel can be connected to the suction channel.

A second liner of a fluid-absorbing material can be disposed in the second rubber insert cap. The second rubber insert cap can have a tub shape. A second elastically formed sealing lip can surround a second tub-shaped floor of the second rubber insert cap. The second elastically formed sealing lip can hermetically seal the second ink jet print head upon pressing-on of the second rubber insert cap onto the ink jet print unit. A second web included in the second elastically formed sealing lip can surround the second tub floor of the second rubber insert cap. The second web can be constructed like lamellas based on cross ribs. The second elastically formed sealing lip can limit a rubber insert cap opening. The second sealing lip can disposed on the second web. The second elastically formed sealing lip can provide a second lock stop for the second fluid-absorbing liner. The second elastically formed sealing lip can be constructed for securing the second fluid-absorbing liner disposed in the second rubber insert cap against falling out. A second burl-shaped extension can be disposed at the second rubber insert cap. The second burl-shaped extension can be disposed at a second floor of the second rubber insert cap. The second burl-shaped extension can serve for an attachment of the second rubber insert cap in the single form part. The second burl-shaped extension, disposed at the floor of the rubber insert cap, can receive one of the pressure compensation channel and the suction channel.

A plurality of ink jet print heads can be disposed on a printer carriage and can form with the printer carriage an ink jet print unit. The cleaning and sealing station can comprise a swivel lever support. A plurality of tub-shaped elastic insert caps can form a suction and cover cap device. Each one of a plurality of liquid-absorbing liners can be supported by a respective one of the plurality of tub-shaped elastic insert caps. The swivel lever support can movably support the suction and cover cap device. The plurality of tub-shaped elastic insert caps can be of a number equal to the plurality of ink jet print heads. The swivel lever support with the suction and cover cap device can be tiltable toward the ink jet print unit.

The swivel lever support can be a positioning device for positioning the cleaning and sealing station with the plurality of tub-shaped elastic insert caps at a relative position to the plurality of ink jet print heads. The swivel lever support can include a first centering finger and a second centering finger. The swivel lever support can be spring tensioned.

The cleaning and sealing station can comprise a plurality of pressure compensation channels. Each of the plurality of pressure compensation channels can be coordinated to one of the plurality of tub-shaped elastic insert caps for a compensation of pressure in the tub-shaped elastic insert caps. The plurality of pressure compensation channels can in each case include a fourth chamber, a first passage opening, and a third opening bore. Each one of a plurality of suction channels can be coordinated to one of the plurality of tub-shaped elastic insert caps for a withdrawal of ink. The plurality of suction channels can include in each case a first chamber and a second chamber. The plurality of the pressure compensation channels, including in each case the fourth chamber, the first passage opening, and the third opening bore, can be coupled to a pressure compensation device. The pressure compensation device can include a ventilation port, a ventilation valve, a pressure compensation chamber, and a film bubble. A common withdrawal channel can be connected to the first chamber and the second chamber of the suction channels. The common withdrawal channel can include a catch basin and a recess. A suction device can be formed by a bellows and can be connected to the common withdrawal device. One valve device can be coordinated to each one of the plurality of suction channels, formed by a first chamber and by a second chamber, for a controlled withdrawal of ink from each one of the plurality of tub-shaped elastic insert caps. The valve device can include a sieve and a slot valve.

A common ventilation channel can be coupled to the pressure compensation channels. The common ventilation channel can include a trough and an air channel. A controllable closure can be furnished by the ventilation valve and can be disposed at the common ventilation channel. Said controllable closure can be provided for feeding in an amount of air as required depending on an operation position of the suction and cover cap device.

A membrane film can be formed by a film bubble. A pressure compensation device can be formed as a closed system relative to ambient air. One common pressure compensation chamber can be provided for the pressure compensation channels including the fourth chamber and the trough. The membrane film formed by the film bubble can close said common pressure compensation chamber relative to ambient air.

The sieve of the valve device can be coordinated to the suction channels including the second chamber and the first chamber. The sieve can be formed by a capillary filter disposed in one respective suction channel of the plurality of suction channels. A suction pressure, acting at the withdrawal channel including a suction port, the catch basin, and an oval-shaped recess, can be selected such that the capillary filter is only overcome and passed through by inflowing ambient air through the suction channels, including the second chamber and the first chamber, when all suction channels are empty of ink.

The slot valve of the valve device can be formed as a one-way directional valve. The one-way directional valve can open in a suction direction of the ink and can close in a direction opposite to the suction direction of the ink.

A printer which is particularly compact in its outer dimensions can be constructed based on disposing the cleaning station and sealing station in the overshoot region, wherein the overshoot region serves for acceleration and braking of a printer carriage. This disposition of the cleaning and sealing station in a particularly provided standby position or parking position outside of the operating region of the ink jet print head thus becomes unnecessary and is thereby eliminated.

The cleaning and sealing station is supported floating slidably and shiftably in a lateral direction and exhibits adjusting elements according to an advantageous embodiment of the invention, where the cleaning and sealing station is aligned to the ink jet print head through the adjustment elements for the exact docking of the cleaning and sealing station. This reduces substantially the control expenditure requirements for positioning the ink jet print head in the overshoot region during the docking and large constructive tolerances can be permitted.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 1:
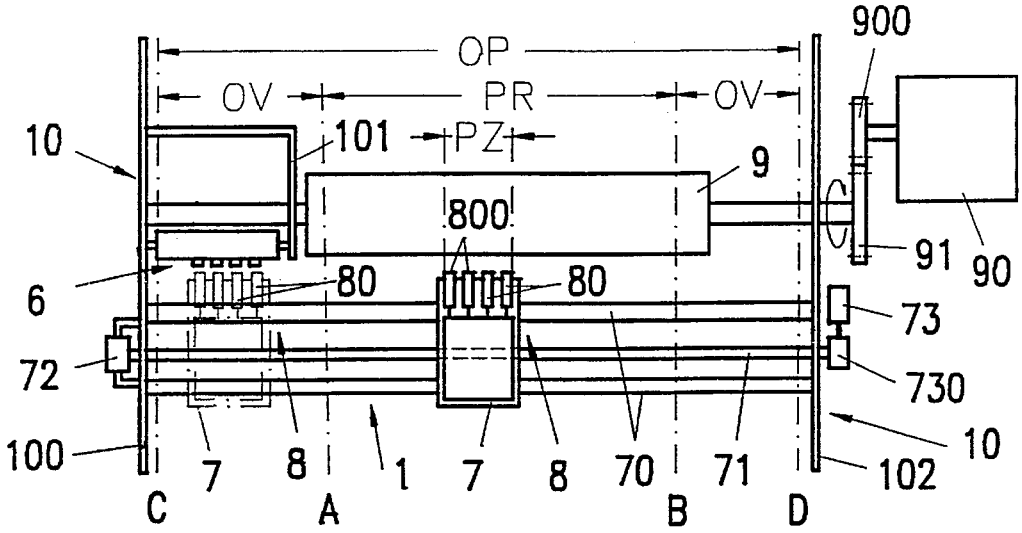
FIG. 1 illustrates a top plan view onto an ink jet print device.

According to the present invention, there is provided for an ink jet print device with the following features. At least one ink jet print head 80 is disposed movable back and forth in a work region OP along a print support platen 9 and a cleaning and sealing station 6. The print support platen receives a recording substrate. The work region OP exhibits a printing region PR and overshoot regions OV. The overshoot regions adjoin at the printing region PR and serve for accelerating and braking a back and forth movable ink jet print head 8. The cleaning and sealing station 6 is disposed in an overshoot region OV.

The cleaning and sealing station 6 can be constructed as an autonomous construction unit which can be exchangeably inserted into the ink jet print device.

The cleaning and sealing station 6 can exhibit a support 3, 3*b* for a suction and cover device 4, 4*a*, 4*b*. The support 3, 3*b* can be constructed swivelable toward the ink jet print heads 80 for suctioning ink from the ink jet print heads 80 and covering the ink jet print heads 80.

The support 3, 3*b* can include an adjustment device 33, 34, 33*b*, F3, F4. The adjustment device 33, 34, 33*b*, F3, F4 can position the support 3, 3*b* with respect to the relative position of the support 3, 3*b* to the ink jet print heads 80. The support member for the suction device and for the covering device 4, 4*a*, 4*b* can be movably supported by means of the positioning device 3, 3*b* between two lateral relative positions of the ink jet print unit 8 with respect to the suction and cover device 4, 4*a*, 4*b*.

A motor-driven cam disk 20 can be furnished for the tilting of the support 3, 3*b*. The support 3, 3*b* can be spring-supportably resting at the cam disk 20. A pivot drive 30 for the support 3, 3*b* can be coupled with a pump 5 for the suctioning of the ink from the suction and cover device 4, 4*a*, 4*b*.

The motor-driven cam disk 20 can exhibit two cam paths 201, 202. Said cam paths 201, 202 can join each other. A running wheel 21, coordinated to the support 3, 3*b* can be guided on the cam paths 201, 202.

A switch tongue 203 can engage matchingly the cam disk 20. The switch tongue 203 can initiate a pumping of the ink or, respectively, a decoupling of the suction and cover cap 4, 4*a*, 4*b* from the ink jet print unit 8 based on controlling the circumferential path of the running wheel 21 around the cam disk 20 as a function of the direction of rotation of the motor-driven cam disk 20 for the suction and cover cap 4, 4*a*, 4*b* coupled to the ink jet print unit 8.

The suction and cover device 4, 4*a*, 4*b* can exhibit a plurality of elastically formed insert caps 41, 41*a* with a respective plurality of liquid-absorbing liners 42, 42*a* for hermetically sealing the ink jet print heads 80 during the suctioning of the ink from the ink jet print heads 80 and for covering the ink jet print heads 80.

A suction and cover device 4, 4*a*, 4*b* can comprise elastic insert caps 41, 41*a* positionable against the ink jet print heads 80 corresponding to the number the ink jet print heads 80. Each one of a plurality of pressure compensation channels 403, 415, 463 can be coordinated to one respective insert cap of the plurality of insert caps 41, 41*a* for a pressure compensation in the insert cap. Each of a plurality of suction channels 401, 400 can be coordinated to one of the plurality of insert caps for the withdrawal of the ink. A plurality of pressure compensation channels 403, 415, 463 for and connected to the plurality of insert caps 41, 41*a* can be coupled to a pressure compensation device 43, 55, 403*a*, 423. The plurality of suction channels 401, 400 can join into a common withdrawal channel 49, 470. The common withdrawal channel 49, 470 can be connected to a suction device 51. A plurality of valve devices 48, 420 can be provided, with each valve device 48, 420 coordinated and connected to each one of the plurality of suction channels 401, 400 for a controlled withdrawal of ink from each one of the plurality of insert caps 41, 41*a*. The pressure compensation device can exhibit a common ventilation channel 465, 430, coupled to the plurality of pressure compensation channels. The common ventilation channel can have a controllable closure 55 for the feeding of air as required depending on the operating position of the suction and cover device.

The pressure compensation device can be formed as a closed system relative to the ambient air, with a common pressure compensation chamber 403*a* for the plurality of pressure compensation channels 403, 465 and a membrane film 423, closing the pressure compensation chamber 403*a* relative to the ambient air.

The plurality of valve devices, coordinated to the plurality of suction channels 401, 400, can include a plurality of capillary filters 48 disposed in one respective suction channel of the plurality of suction channels. A suction pressure acting at the withdrawal channel 45, 49, 464 can be selected such that, upon emptying the plurality of suction channels of ink, the capillary filter 48 can only then overcome by the inflowing ambient air through the plurality of suction channels 400, 401 when the plurality of suction channels no longer contains any ink.

The plurality of valve devices, coordinated and connected to the plurality of suction channels 400, 401 can include a plurality of one-way directional valves 420. Each one of the plurality of one-way directional valves 420 can open in suction direction of the ink and can close in an opposite direction relative to the suction direction of the ink.

FIG. 1 illustrates in a top plan view onto a construction in principle of an ink jet print device 1. It is a characteristic feature of the construction of the ink jet print device 1 that an ink jet print unit 8 is disposed on a printer carriage 7. The ink jet print unit 8 can be moved parallel to a print counter support formed by a roller platen 9 rotatably supported in two casing walls 100 and 102 of a support frame 10. The roller platen 9 is driven by a drive device 90 with a first drive pinion 900 via a gear train 91 in the illustrated direction of rotation. The roller platen 9 transports a sheet-shaped recording substrate into a printing zone PZ, formed by the ink print unit 8 and the roller platen 9, where the recording substrate extends for example over a print region PR. In order to be able to print onto the recording substrate and assuming the ink jet print device 1 is constructed as a four-color printer, the ink jet print unit 8 in the present case exhibits side-be-side disposed ink jet print heads 80 with nozzle ejection faces 800 disposed toward the recording substrate. The four available color print fluids are the colors yellow, magenta, cyan and black. The colored print fluids can thereby be arbitrarily coordinated to the four different ink jet print heads 80. It is recommended, however, based on purposes associated with the cleaning of the ink jet print heads 80, that the colors be coordinated in the recited sequence to the ink jet print heads 80 from the right to the left.

The region of the sheet-shaped recording substrate, disposed opposite to the ink jet print heads 80, is designated as print zone PZ. In order to be able to print onto the sheet-shaped recording substrate over the complete width of the print region PR, the printer carriage 7 is moved back and forth on two parallel disposed guide rods 70 attached in the casing walls 100, 102. The back and forth movement of the printer carriage 7 is performed, as described in the German Utility Patent document DE-GM 89 06 727, based on a flexible pulling means and traction mechanism 71, which wraps shape-matchingly around a deflection roller 72 and a second drive pinion 730 of an electromotor 73.

The printer carriage 7 with the ink jet print unit 8 is moved back and forth between the positions delimiting the print region PR for printing onto the recording substrate guided by the roller platen 9 into the print region PR. In this context, both a one-directional printing operation as well as bidirectional printing operation are possible as mode of operation. In case of the one-directional printing operation, the recording substrate is imprinted line by line only in one direction of motion. In case of a bidirectional printing operation, which allows a substantially higher printing speed, the recording substrate is imprinted line by line in the print region PR in both directions of motion of the ink jet print unit 8 including the ink jet print head.

Independent of the mode of operation, the printer carriage 7, disposed in a rest position C outside of the print region PR, is initially accelerated up to the position "A" upon print start, such that the printer carriage 7 achieves the speed required for the continuous printing relative to the recording substrate. The position A defines the first possible print position. Subsequently, the printer carriage 7 is moved with constant speed for the printing in the actual print region PR until it reaches the position B. The position B determines the last possible print position of the print region PR. After surpassing the position B, the printer carriage 7 is braked up to the position "D" representing a right end position of the printer carriage and is brought to rest, and then the recording substrate is advanced further by a printing line with the roller platen 7. For printing the following line, the printer carriage is accelerated in an opposite direction from the position "D" into the position "B", which position "B" now determines the first print position of the following line to be printed. After reaching the print speed in the position "B", the following line can then be printed between the positions "B" and "A". When the printer carriage 7 reaches the last possible print position "A", then the printer carriage 7 is again braked up to the position "C" representing a left end position of the printer carriage. Thus, the positions "C" and "D" represent outer most positions of the print carriage. The positions "A" and "B" represent the left and right extreme printing positions of the carriage and the distance difference position "B" minus position "A" represents the printing width of the printer. At this point "C", a renewed line advance with renewed line printing is performed. Line by line of the recording substrate is now printed in the described fashion.

In the one-directional printing operation it is advantageous to move the printer carriage in a quick return from the position "B" into the position "C".

The path distances "C"-"A" and "B"-"D" are designated in the following as overshoot regions OV. The two overshoot regions OV, together with the print region PR determine an operating region OP for the ink jet print unit 8. The minimum length of the path distances C-A and B-D is determined by the physically required acceleration distance and braking distance under consideration of the mechanical tolerances. The embodiment described in connection with FIG. 1 has an overshoot region OV of a length of about 40 millimeters.

Soiling at the ink jet print heads 80 can occur during the printing operation based on paper dust. Therefore, the ink jet print heads 80 have to be cleaned from time to time. The ink jet print heads 80 are thereby flushed such that the ink is suctioned out of the ink jet print heads 80 via the nozzle ejection openings. The flushing of the ink jet heads 80 also prevents simultaneously that the ink dries at the nozzle ejection openings of the ink jet print heads 80, which were not used during the writing operation. For this purpose, a cleaning and sealing station 6 is furnished in the ink jet print device 1. The cleaning and sealing station 6 is disposed in an overshoot region OV of the printer carriage 7. This can be both a left-side as well as a right-side overshoot region OV. The left-side overshoot region has proven to be advantageous for positioning a cleaning and sealing station 6.

The printer carriage 7 is moved up to the left rest stop at the casing wall 100 of the support frame 10 in the overshoot region OV for the cleaning of the ink jet print heads 80. The casing wall 100 thereby forms a common reference edge for the cleaning and sealing station 6 and for the printer carriage 7, where the reference edge is of importance for defining the cleaning process. By way of the description of FIGS. 2 through 32, it is illustrated how the cleaning process is performed in detail.

Figure 2:
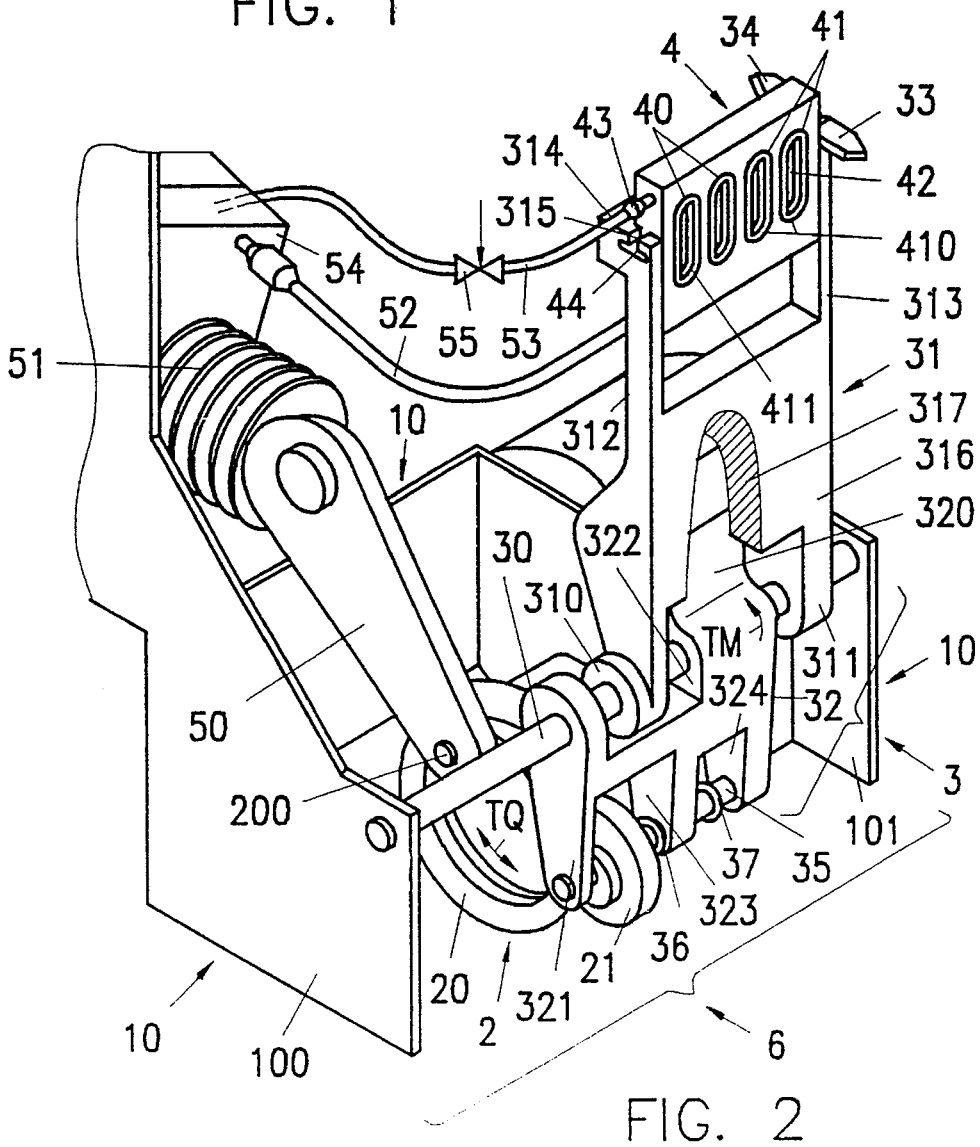
FIG. 2 is a perspective view of a cleaning and sealing station.

FIG. 2 shows a perspective representation of the construction of the cleaning and sealing station 6, designated in the following as cleaning and sealing CS station 6. The cleaning and sealing CS station 6 is thereby designed and constructed as an autonomous and self-contained construction unit operating independently of the ink jet print device 1. The cleaning and sealing CS station 6 can be employed as a closed, independent and separately exchangeable construction unit in the ink jet print device. This is associated with the advantage that the cleaning and sealing CS station 6 can be employed as an original equipment manufacturing OEM product in various ink jet print devices. Various servicing treatments of the ink jet print heads 80 are performed with the cleaning and sealing CS station 6, where the servicing treatments are necessary for an interference-free operation of the ink jet print device 1. These servicing treatments comprise amongst others: the cleaning of the ink jet print head 80 with its nozzle ejection openings at predetermined time intervals in order to prevent thereby a drying and soiling of the nozzle ejection openings; the suctioning of ink contained in the ink jet print head 80 in case of interferences, for example, in order to remove air which has entered; and the covering of the nozzle ejection openings in a rest state of the ink jet print device 1, in order to protect the nozzle ejection openings from drying and soiling, for example, by a dust deposit of paper dust. Furthermore, the ink jet print device 1 has to be prevented from leaking ink out of the nozzle ejection openings during transportation and storage.

Since the cleaning and sealing CS station 6 is disposed within the overshoot region OV for the printer carriage 7 supporting the ink jet print unit 8 in the ink jet print device 1 and resulting from the writing operation of the ink jet print device 1 according to FIG. 1, there results a narrower construction of the ink jet print device 1 as compared to a situation where a separate space would be required for the sealing and cleaning CS station 6 in the longitudinal direction of the platen 9.

The cleaning and sealing CS station 6 cannot be allowed to block the overshoot region of the printer carriage 7 between the position A and the position C according to FIG. 1 during print operation, when the printer carriage 7 is temporarily present in the overshoot region OV based on acceleration and braking processes.

During servicing operation, when the nozzle ejection openings of the ink jet print unit 8 are to be cleaned, the cleaning and sealing CS station 6 has to be docked at a precise position at the ink jet print unit 8 and the ink is suctioned from the nozzle ejection openings. The term "docking" refers in this context to the coupling of the cleaning and sealing CS station 6 to the ink jet print unit 8.

The nozzle ejection openings have to be protected from drying in the rest position, during transport, and during the storing of the ink jet print device 1. Furthermore, no ink can be allowed to flow out. Therefore it is necessary that the cleaning and sealing CS station 6 is docked at a precise position at the ink jet print unit 8 and that the nozzle exit openings are thereby closed.

The cleaning and sealing CS station 6 includes a switch coupling 2, a swivel lever 3, a suction and cover cap 4, as well as a bellows pump 5. The switch coupling 2 exhibits a cam disk 20 and a running wheel 21, where the running wheel 21 rolls off on the cam disk 20. For receiving a torque TQ, the cam disk 20 is attached in a shape matching way on a drive shaft of a further electromotor, not illustrated in FIG. 2. Preferably a DC motor is employed as an electromotor.

Furthermore the cam disk 20 exhibits a protrudingly and eccentrically disposed crank pin 200 on the front face side disposed away from the electromotor. The crank pin 200 is connected via a linkage 50 with a bellows 51 of the bellows pump 5. The bellows 51 are alternately pulled apart or, respectively, pressed together via the linkage 50 based on the rotation of the cam disk 20 with the eccentrically disposed crank pin 200. The thereby generated pump action of the bellows pump 5 is employed in the present cleaning and sealing CS station 6, for example, in order to pump the ink out of the nozzle ejection openings of the ink jet print heads 80 in FIG. 1. The bellows pump 5 is connected both through a hose 52 as well as through an air hose 53 to the suction and cover SC cap 4. It is however also possible to suction and to discharge other liquids from various injection spray devices with the cleaning and sealing CS station 6.

Four equally sized, identically shaped recesses 40, formed as suction openings, or hollow spaces, are disposed in the suction and cover SC cap 4 for pumping the ink from the ink jet print heads 80 of the ink jet print device 1. These recesses 40 are either connected via the hose 52, providing a suction channel to a discharge container 54, attached at the bellows pump 5, or the recesses 40 are connected via the air hose 53, providing a pressure compensation channel to the ambient air. The air hose 53 exhibits a controllable ventilation valve 55, coupled for example with the bellows pump 5. For this purpose the air hose 53 is put over and attached to a ventilation port 43, wherein the ventilation port 43 protrudes on the side out of the suction and cover SC cap 4. The ink can also be suctioned with a hose pump, a piston pump, or a membrane pump out of the nozzle ejection openings as an alternative to the bellows pump 5.

The number of the recesses 40, which are contained in the suction and cover SC cap 4 of the cleaning and sealing CS station 6 depends on the number of ink jet print heads employed. If, as in the instant case, for example a multicolored print image is to be produced with the ink jet print device 1, then the servicing treatment of the ink jet print device 1 has also to be designed for the discharging of the required four ink jet print heads. In order to avoid a mixing of the writing fluids during the suctioning from the nozzle ejection openings of the ink jet print heads, the number of the recesses 40 or, respectively, of the suction openings is identical to the number of the colored writing fluids employed and coordinated to the ink jet print heads.

In each case, a tub-shaped rubber insert 41 in the shape of an elastic rubber insert cap is disposed in the suction openings or recesses 40 on the side of the suction and cover SC cap 4, disposed toward the ink jet print unit 8. This rubber insert cap 41 supports a liquid-absorbing liner 42. The suction and cover SC cap 4, as already mentioned, is docked onto the ink jet print unit 8 for pumping the ink from the ink jet print heads 80, wherein the elastic caps or rubber inserts 41 are put over the nozzle ejection openings of the ink jet print heads for covering the nozzle ejection openings. If mention is made in the following of docking the suction and cover SC cap 4, then this is intended to refer to a lateral shifting and tilting of the cap 4. A sealing lip 410 is disposed on the tub-shaped rubber insert cap 41 such that the ink can be pumped without difficulty through the suction openings 40 as well as through the hose 52. The sealing lip surrounds a tub opening 411 of the rubber insert cap 41 and is pressed against the ink jet print unit 8 during the docking of the suction and cover SC cap 4 and whereby the nozzle ejection openings of the ink jet print heads 80 are hermetically sealed.

The docking of the suction and cover SC cap 4 is effected by the swivel lever 3. The swivel lever 3 is shiftably and pivotably supported on a first axle 30 clamped between the casing wall 100 and a further casing wall 101 of the support frame 10. The frictional influences have to be kept as small as possible in order to be able to perform the shifting and pivoting of the swivel lever 3 with a minimal force expenditure.

The swivel process is released and triggered by transforming the torque TQ, delivered by the electromotor, through the switch coupling 2 into a tilting moment TM acting and engaging at the swivel lever 3. The swivel lever 3 is spring-supported and tensioned via the running wheel 21 at the cam disk 20 for achieving the transformation of the torque TQ. The swivel lever 3 is constructed of two parts, thereby subdividing the dead weight of the swivel lever 3, co-responsible for the frictional influences, in order to maintain the forces small which occur during spring tensioning. The two-part construction of the swivel lever 3, however, is explained substantially in that a lateral shifting of the swivel lever 3 can be required for a position-precise docking of the suction and cover SC cap 4. In case of a one-piece construction, this docking would result in a shifting of the running wheel 21 on the cam disk 20. The running surface for the running wheel 21 on the cam disk 20 would have to be designed for a maximum possible lateral shifting during the docking in case of a one-piece construction of the swivel lever 3.

An upper lever part 31 of the swivel lever 3 supporting the suction and cover SC cap 4 is disposed on the first axle 30, tiltable and shiftable via two swivel arms 310, 311. The upper lever part 31 of the swivel lever 3 exhibits furthermore two oppositely disposed support arms 312, 313. The support arms 312, 313 are connected to each other on the side remote relative to the ink jet print unit 8 through a U-shaped cross bracing 314. According to a first embodiment, in each case a T-shaped recess 315 is inserted and trimmed in the arms of the U-shaped cross-bracing 314 for the support of the suction and cover SC cap 4. This T-shaped recess serves for the freely movable support of bearing pins 44 of the suction and cover SC cap 4. The bearing pins 44 are pressed into the T-shaped recess 315 for supporting the suction and cover SC cap 4. The upper lever part 31 exhibits in addition a rectangular center part 316, between the swivel arms 310, 311 and the support arms 312, 313, wherein a pocket-shaped recess 317 is set into the lever upper part 31.

A positioning device is furnished for docking the suction and cover SC cap 4 with a precise position at the ink jet print unit 8. The positioning device comprises two opposingly disposed centering fingers 33, 34, wherein the centering fingers 33, 34 end in an acute angle in the swivel direction of the swivel lever 3. The centering fingers 33, 34 are disposed on the side of the support arm 313 on the arm of the U-shaped cross-bracing 314. A first centering finger 33 locates for this purpose during the swivelling of the swivel lever 3 automatically a centering window 81 (FIG. 12) formed in the ink jet print unit 8 but not illustrated in FIG. 2 and the first centering finger positions thus the cleaning and sealing CS station 6 opposite to the ink jet print unit 8. The lever 3 can be shifted lateral with the cleaning and sealing CS station 6 for positioning purposes.

The tilting moment TM is transferred onto the upper lever part 31 of the swivel lever 3 through a lower lever part 32 of the swivel lever 3 for purposes of docking the suction and cover SC cap 4. The lower lever part 32 is disposed pivotably on the axle 30 for this purpose just as is the lever upper part 31. A characteristic feature of the lower lever part 32 are a lever arm 320 and a side arm 321, where the axle 30 is inserted through the lever arm 320 and the side arm 321 centered or, respectively, at the end point. A first recess 322 is furnished between the lever arm 320 and the side arm 321 in the region of the axle 30, where the swivel arm 310 of the upper lever part 31 is disposed. The dimensions of the recess 322 are selected in this context such that the upper lever part 31 can be shifted lateral depending on need independently of the lower lever part 32. In addition, a second recess 323 is furnished between the lever arm 320 and the side arm 321, where the running wheel 21 is axially movable and rotatably supported on a second axle 35 in the second recess 323. Furthermore, a first spring 36 is disposed on the axle 35 within the recess 323, wherein the first spring 36 opposes the axial movability of the running wheel 21 with a first spring force F1. The axle 35 additionally grips through a third recess 324, wherein the third recess 324 is set into the foot point of the lever arm 320. A second spring 37 of a spring force F2 is hung at the axle 35 within this third recess 324, wherein the second spring 37 is in addition also connected with the support frame 10 of the ink jet print device 1 for the swivelling process of the swivel lever 3, this feature, however, is not visibly illustrated in FIG. 1.

The running wheel 21 is pressed against the cam disk 20 by the second spring force F2 of the spring 37. The swivel motion of the swivel lever 3, required for the docking of the suction and cover SC cap 4, is transferred from the lever arm 320 of the lower lever part 32 onto the upper lever part 31. The lever arm 320 grips and engages for this purpose sliding block-like with a small play in swivel direction of the swivel lever 3 into the pocket-shaped recess 317 of the upper lever part 31 between the swivel arms 310, 311. In order to be able to shift the upper lever part 31 on the axle 30, the pocket-shaped recess 317 of the upper lever part 31 is wider relative to the lever arm 320 of the lower lever part 32 by a such amount, which is required for a lateral shifting of the upper lever part 31 and thus of the suction and cover SC cap 4 for allowing a shifting of the lever upper part 31 on the axle 30.

Figure 10:
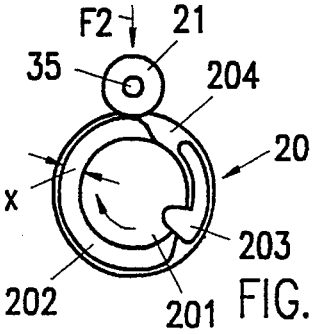
FIG. 10 is a view similar to FIG. 3, illustrating a sixth state of the switch coupling.
Figure 11:
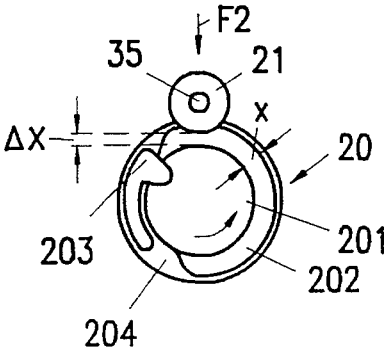
FIG. 11 is a view similar to FIG. 3, illustrating a seventh state of the switch coupling.

FIGS. 3 through 7 as well as FIGS. 10 and 11 illustrate in a side elevational view the construction and the mode of operation of the switch coupling 2 by way of rotation angle dependent on the states of the switch coupling 2 for different directions of rotation of the cam disk 20. The two directions of rotation of the cam disk 20 are employed in order to realize the modes of operation of the cleaning and sealing CS station 6 recited in the description of FIG. 2. During the clockwise rotation of the cam disk 20 according to the FIGS. 3, 5 and 10, the suction and cover SC cap 4, integrated in the swivel lever 3, is in continuous alternation docked in the ink jet print unit 8 (FIG. 3) and again lifted off from the ink jet print unit 8 (FIG. 10). During a counter clockwise rotation of the cam disk 20 according to FIGS. 4, 6, 7 and 11, the swivel lever 3 is docked at the ink jet print unit (FIG. 4) and the ink is suctioned for such a time from the nozzle ejection openings of the ink jet print head by the bellows pump 5 (FIGS. 6, 7, 11) until the direction of rotation is changed again.

The cam disk 20 exhibits two radially running cam paths 201, 202 stepped from each other by a step shoulder x for the swivelling or, respectively, suction process. A motion-releasing outer cam path 202, according to FIGS. 3, 4 and 10, serves as a bearing surface for the running wheel 21 rolling on the cam disk 20. The full step shoulder x between the cam path 201, 202 is effective for example for two thirds of the peripheral circumference on the cam disk 20 in order to be able to perform a required stroke for lifting the suction and cover SC cap 4 from the ink jet print unit 8 and for docking the suction and cover SC cap 4 at the ink jet print unit 8. The position of the running wheel 21 is shifted under the spring force F2 or, respectively, against the spring force F2 by the amount for the stroke relative to the cam disk 20 by having the motion-releasing outer cam path 202 follow, nestled and snugly fit, at these positions at an inner cam path 201 formed as an idle path.

Figure 3:
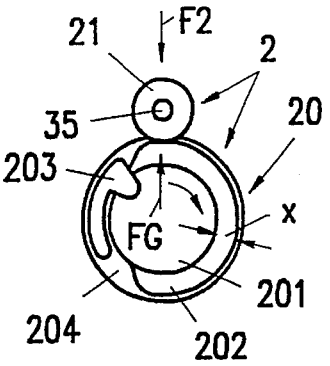
FIG. 3 is a side elevational view of a switch coupling in a first temporary state dependent on the direction of rotation of the switch coupling.
Figure 4:
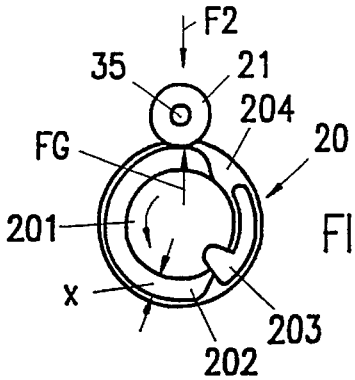
FIG. 4 is a view similar to FIG. 3, illustrating a second temporary state of the switch coupling.

A possible initial state of the switch coupling 2 is illustrated in each case in FIGS. 3 and 4, wherein the running wheel 21 is resting on the outer cam path 202 of the cam disk 20 and wherein the suction and cover SC cap 4, integrated into the swivel lever 3 according to FIG. 2, is thereby disposed in a lifted-off state relative to the ink jet print unit 8. A compensation force CF compensating the spring force F2 is thereby accepted from the rotatably disposed cam disk 20. The running wheel 21, the swivel lever 3 and the suction and cover SC cap 4 form a double-arm mechanical lever arrangement, wherein the spring force F2, acting onto the lever arrangement, is compensated either by the running wheel 21 or the suction and cover SC cap 4. If the cam disk 20 is now rotated toward the right in the arrow direction according to FIG. 3 or, according to FIG. 4, toward the left, then the running wheel 21 leaves subjected to the spring force F2 the outer cam path 202 of the cam disk 20 in the two cases. The thereby generated shifting in position of the running wheel 21 effects according to FIG. 2 the docking of the suction and cover SC cap 4 at the ink jet print unit 8 in that the swivel lever 3 is swivelled by the amount of the stroke.

Depending on the state of the ink jet print device 1, for example, writing or service operation as well as rest position either the pumping process, for example occurring during the left rotation of the cam disk 20, or the lifting off of the suction and cover SC cap 4 has now to be initiated for the predetermined direction of rotation of the cam disk 20. A switch tongue 203 operating according to the coupling principle is furnished for this purpose. The switching tongue is disposed in the region of the cam disk 20 outside of the step shoulder x. The switch tongue covers the inner cam path 201 at an angle, the switch tongue 203 is fixedly connected at one end with the cam disk 20, and the switch tongue 203 rests at the second end springingly at an edge 204 of the cam disk 20. The switch tongue 203 is dimensioned such and disposed such on the cam disk 20 that the running wheel 21 does not perform any further positional shifting during the left rotation of the cam disk 20. Thus, the running wheel 21 idles relative to the moved cam disk 20 and the running wheel can perform two positional shiftings per rotation during the right rotation of the cam disk 20.

The proper selection of the rotation direction in dependence on the mode of operation of the ink jet print device 1 is thereby effected by a control device, where the control device, such as the cleaning and sealing CS station 6, is a component of the ink jet print device 1. The control device is coupled for this purpose to the electromotor. The control device comprises for example a microprocessor for the control of the electromotor, where the microprocessor changes via a generally known electronic switching arrangement the polarity of a supply voltage, applied at the electromotor, and thus changes the rotation direction of the electromotor. The electromotor 73 and the drive device 90 according to FIG. 1 are also controlled by the control device in addition to the control of the electromotor of the cleaning and sealing CS station 6. The control device is constructed in a generally known and conventional fashion.

Figure 5:
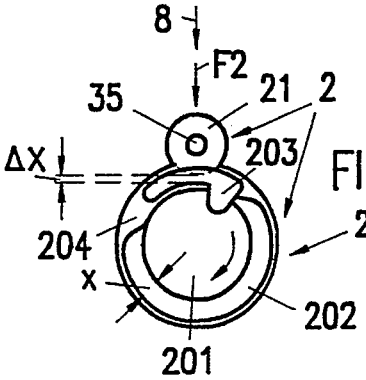
FIG. 5 is a view similar to FIG. 3, illustrating a third temporary state of the switch coupling.
Figure 6:
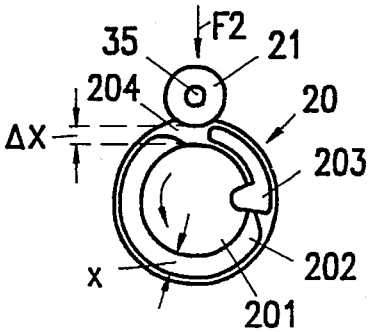
FIG. 6 is a view similar to FIG. 3, illustrating a fourth temporary state of the switch coupling.
Figure 7:
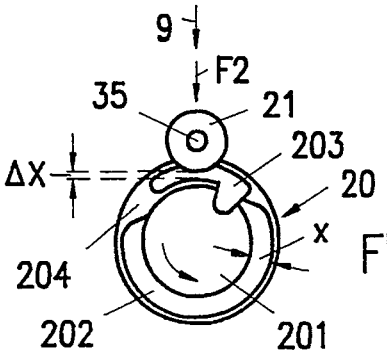
FIG. 7 is a view similar to FIG. 3, illustrating a fifth temporary state of the switch coupling.

FIGS. 5, 6 and 7 show in each case a temporary state of the switch coupling 2, where the running wheel 21 has left the outer cam path 202 and where the suction and cover cap 4 is thus docked at the ink jet print unit 8. It is characteristic for this state illustrated in FIGS. 5, 6, and 7, that the running wheel 21 does neither rest on the outer cam path 202 nor on the inner cam path 201 of the cam disk 20 in the docked state of the suction and cover SC cap 4. If the running wheel 21 leaves the outer cam path 202, then the mechanical lever arrangement strives to reassume a rest position under the influence of the spring force F2. This is achieved thereby, that in contradistinction to FIGS. 3 and 4, where the compensation force CF compensating the spring force F2 has to be provided by the rotatably supported cam disk 20, the compensation force CF compensating the spring force F2 is now being furnished by the ink jet print unit 8. This means that the stroke to be performed by the swivel lever 3 for the docking of the suction and cover SC cap 4 at the ink jet print unit 8 is smaller than the step shoulder x between the cam paths 201, 202 of the cam disk 20. Thus, there results an air gap X by the amount of which the running wheel 21 is lifted off from the inner cam path 201 of the cam disk 20. The air gap X achieves that during a path change of the running wheel 21. according to FIG. 6 and 7 there does not occur any additional frictional influence. Consequently, the spring force F1, which presses the running wheel 21 against the edge 204 of the cam disk 20 can be small. A typical stroke value for the cleaning and sealing CS station 6 amounts to for example between 6 and 10 mm. While the running wheel 21 according to FIG. 5 is moved relative to the cam disk 20 between the edge 204 and the switch tongue 203, the running wheel 21 is moved past the switch tongue 203 relative to the cam disk 20 according to FIGS. 6 and 7.

Figure 8:
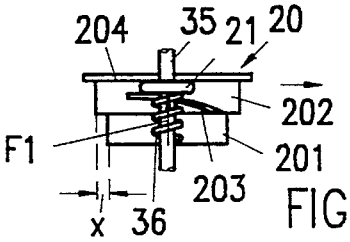
FIG. 8 is a top plan view onto a switch coupling in a temporary state.
Figure 9:
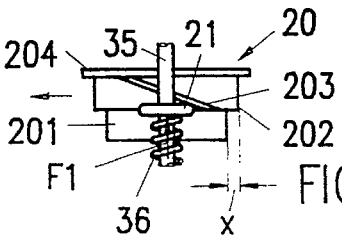
FIG. 9 is a top plan view onto a switch coupling in a temporary state.

FIGS. 8 and 9 shows in each case in a top plan view of the temporary state of the switch coupling 2 according to FIG. 5 or, respectively, FIG. 7. This illustrates that the running wheel 21 on the axle 35 and pressed by the spring 36 with the spring force F1 against the edge 204 of the cam disk 20, is moved through the switch tongue 203 and the edge 204 relative to the cam disk 20 during the clockwise rotation of the cam disk 20 in FIG. 8 and that the running wheel 21 is led past the switch tongue 203 relative to the cam disk 20 upon a counter clockwise rotation of the cam disk 20 in FIG. 9.

The end of the switch tongue 203 pressing springingly against the edge 204 is pressed away from the running wheel 21 during the relative motion of the running wheel 21 according to FIG. 8.

The running wheel 21 is shifted on the axle 35 and thereby the spring 36 is compressed during the relative motion of the running wheel 21 according to FIG. 9. The spring 36 is thereby compressed by the running wheel 21 until the running wheel 21 has passed the switch tongue 203.

FIG. 10 illustrates how the running wheel 21 passes again onto the outer cam path 202 during further rotation of the cam disk 20 in clockwise or right-hand direction against the spring force F2 and how the suction and cover SC cap is thereby lifted off from the ink jet print unit 8. The temporary state of the switch coupling 2 illustrated in FIG. 3 is again achieved and the docking or, respectively, the lifting off of the suction and cover SC cap 4 starts anew during a further right-hand rotation or clockwise rotation of the cam disk 20.

FIG. 11 illustrates how the running wheel 21 is pressed during a further left-hand or counter clockwise rotation of the cam disk 20, after the passing of the switch tongue 203 in FIGS. 7 and 9, through the spring force F1 against the step shoulder x of the cam paths 201, 202 staggered relative to each other. The temporary state of the switch coupling 2 illustrated in FIG. 6 is again achieved during a further counter clockwise or left-hand rotation of the cam disk 20 and the ink is further pumped off from the nozzle ejection openings of the ink jet print heads 80.

Figure 12:
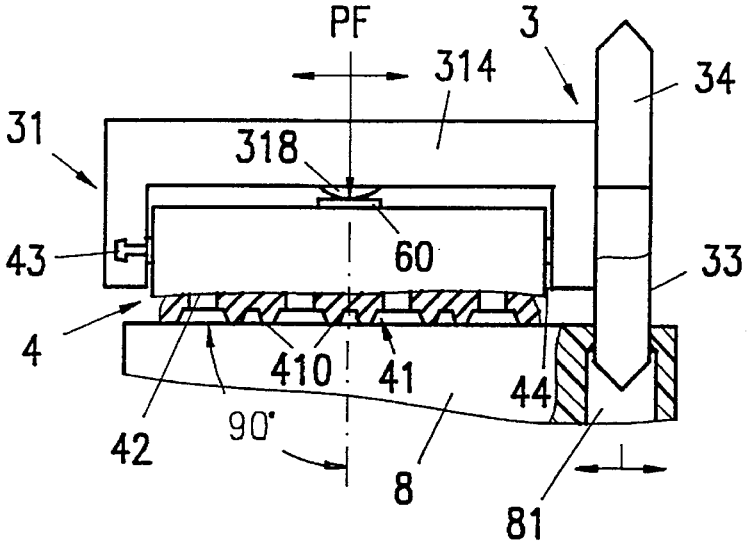
FIG. 12 is a top plan view onto a suction and cover cap supported on a swivel lever of a cleaning and sealing station.

FIG. 12 illustrates in a top plan view the swivelling support of the suction and cover SC cap 4 docked at a precise position at the ink jet print unit 8 in the swivel lever 3. The first centering finger 33 is immersed and inserted into the centering window 81 of the ink jet print unit 8 for the position precise docking of the suction and cover SC cap 4 and the first centering finger 33 aligns thus both the swivel lever 3 as well as the suction and cover SC cap 4 relative to the ink jet print unit 8 in a lateral direction. The autonomous alignment of the suction and cover SC cap 4 independent of the swivel process of the swivel lever 3 is made possible on the one hand in that the suction and cover SC cap 4 is supported tiltable and freely movable in the upper lever part and, on the other hand, in that a press-on force PF required for the docking is transferred centrally and uniformly through the U-shaped cross bracing 314. The U-shaped cross bracing 314 exhibits for this purpose a spherical segment 318 directed toward the center of gravity of the suction and cover SC cap 4, and the press-on force PF is transferred onto the suction and cover SC cap 4 through the spherical segment 318. A press-on plate 60, disposed on the back side of the suction and cover SC cap 4, rests at the spherical segment 318. The suction and cover SC cap 4, which is supported freely movable and swivelled at a right angle relative to the ink jet print unit 8, is also aligned at a right angle relative to the ink jet print unit 8. The press-on force PF corresponds to the amount of the spring force F2 and engages at the swivel lever 3 in a direction opposite to the spring force F2.

Figure 13:
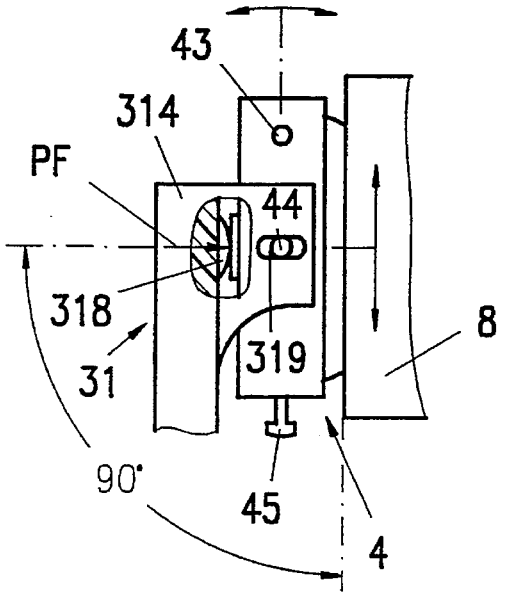
FIG. 13 is a side elevational view of a suction and cover cap supported on a swivel lever of a cleaning and sealing station related to a detail visible in the upper right part of FIG. 2.

FIG. 13 illustrates in a side elevational view how the suction and cover SC cap 4 is supported in the upper lever part 31 of the swivel lever 3. An elongated hole 319 is disposed in the legs of the U-shaped cross bracing 314 according to a second embodiment for the support of the suction and cover SC cap 4, wherein the bearing pins 44 of the suction and cover SC cap 4 are freely movably supported in the elongated hole 319 in the direction of the press-on force PF. The elongated hole 319 is offered for the reason that the position of the suction and cover SC cap 4 relative to the ink jet print unit 8 is not critical in a direction orthogonal to the direction of the press-on force PF for the docking of the suction and cover SC cap 4 at the ink jet print unit 8.

In contradistinction to the first embodiment for the support of the suction and cover SC cap 4, where the suction and cover SC cap 4 is pressed into the T-shaped recess 315, the support arms 312, 313 for the second embodiment have to be pressed apart from each other in order to support the suction and cover SC cap 4 in the swivel lever 3. As a result, the swivel lever 3 is also preferably produced of a plastic material in addition to the suction and cover SC cap 4, the switch coupling 2 up to the switch tongues 203. According to the first embodiment of the support of the suction and cover SC cap 4, it would however also be possible to form all the recited elements of the cleaning and sealing CS station 6 of a metallic material.

FIG. 13 illustrates further a suction port 45 for the hose 52 at the lower side of the suction and cover SC cap 4, where the ink suctioned from the nozzle ejection openings is transferred into the discharge container 54 through the suction port 45.

Figure 14:
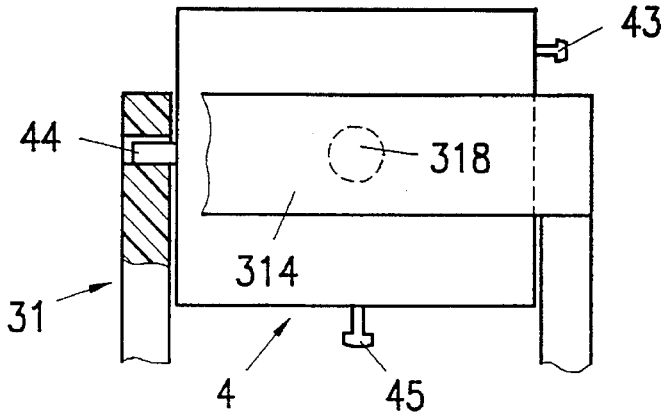
FIG. 14 is a rear elevational view of a suction and cover cap disposed on a swivel lever of the cleaning and sealing station related to a detail corresponding to a rearview of the upper right part of FIG. 2.

FIG. 14 illustrates how the spherical segment 318 is disposed on the inner face of the U-shaped cross bracing 314 and how the suction port 45 is disposed relative to the lower side of the suction and cover SC cap 4 in a rear view of the suction and cover SC cap 4, wherein the suction and cover SC cap 4 is supported tiltably and freely movable in the swivel lever 3.

Figure 15:
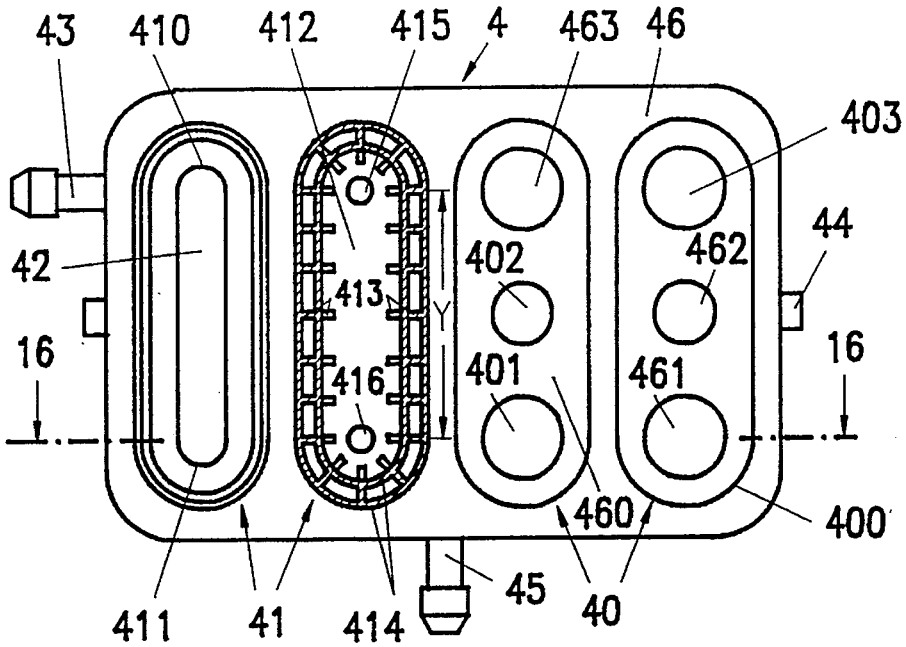
FIG. 15 is a front elevational view onto a first embodiment of a suction and cover cap.

The detailed construction of a first embodiment of the suction and cover SC cap 4 with the four suction openings 40 furnishing hollow spaces for the separate suctioning of the ink from the nozzle ejection openings of the ink jet print heads 80 is shown in FIG. 15 in a top plan view. The rubber insert cap 41 is inserted into two of the suction openings 40 and, in addition, one of the rubber insert cap 41 is cut open in longitudinal direction in order to illustrate both the recess configuration of the suction openings 40 furnishing hollow spaces as well as the construction of the rubber insert cap 41 in FIG. 15.

The suction and cover SC cap 4 exhibits a rectangular, for example in the corners rounded support part 46, where the recess 40 of the suction openings both in the length as well as in the width are, inserted uniformly distributed, into the support part 46. Each of the suction openings or recesses 40 comprises a pressure compensation channel (403, 463) for pressure compensation and a suction channel (461, 401) for the discharging of the suctioned ink as well as a centrally disposed opening 462 for the attachment of the tub-shaped rubber insert cap 41, 41*a*. The suction recess 40 exhibits preferably an oval-shaped first chamber 400 for receiving of the tub-shaped rubber insert cap 41, 41*a*. The tub-shaped rubber insert cap 41 can be inserted in this oval chamber 400 and can be attached at the opening 462. The pressure compensation channel comprises a connection opening 463 with an associated chamber 402 and the suction channel comprises a second connection opening 461 with an associated second chamber 401.

The first chamber 400 can also be formed rectangular with slightly rounded corners instead of an oval shape. However, it has to be assured in this context that the rubber insert cap 41 can still be disposed shape-matchingly in the first chamber 400.

The rubber insert cap 41 with the sealing lip 410, surrounding the tub opening 411, and the liner 42 disposed in the rubber insert 41 has the purpose to seal the nozzle ejection openings of the ink jet print head 80 during the docking of the suction and cover SC cap 4 at the ink jet print unit 8 such that, during the suctioning of the ink, the ink cannot escape at the docking position between the sealing lip 410 and the nozzle ejection face 800 of the ink jet print unit 8. Since the ink is suctioned from the nozzle ejection openings of the ink jet print heads 80 with the aid of a negative pressure, the rubber insert cap 41 on the one hand has to exhibit a certain elasticity for the suctioning of the ink and, on the other hand, the rubber insert 41 has to exhibit a certain stiffness for the docking of the suction and cover SC cap 4. A suitable compromise between the elasticity and the stiffness of the rubber insert cap 41 is achieved by providing that the tub-shaped rubber insert cap 41 according to FIG. 15 includes a tub floor 412, forming the tub shape, with a web 414 formed as a hollow profile with cross ribs 413 and surrounding and edging the tub floor 412. The cross ribs 413 are disposed in the web 414, furnished as a hollow profile, such that a lamella-like structure is generated. On the other hand, the cross ribs 413 protrude as small protrusions on the tub floor 412 into the tub-shaped rubber insert 41. It is thereby achieved that the liner 42 does not rest immediately on the tub floor 412 of the rubber insert 41. Furthermore, two passage openings 415, 416, disposed at a distance y relative to each other, are inserted into the tub floor 412 on the longitudinal axis of the tub floor 412. The tub generally has an elongated shaped formed by two semicircles at the ends of the elongation direction joined by a rectangular section having a width corresponding to the widths of the semicircles and having a length from about 1.5 to 5 times the diameter of the semicircles and preferably from about 2 to 3 times the diameter of the semicircles, where the rectangular section is disposed in the middle between the semicircles. The distance y corresponds preferably to ⅔ of the total length of the longitudinal axis of the tub floor 412. A first passage opening 415 of the rubber insert 41, inserted into the hollow space 40, joins thereby into the pressure compensation channel 403, where the pressure compensation channel 403 is connected to the ventilation port 43. A second passage opening 416 of the rubber insert 41 joins into the suction channel 401, where the suction channel 401 is connected to the suction port 45.

Figure 16:
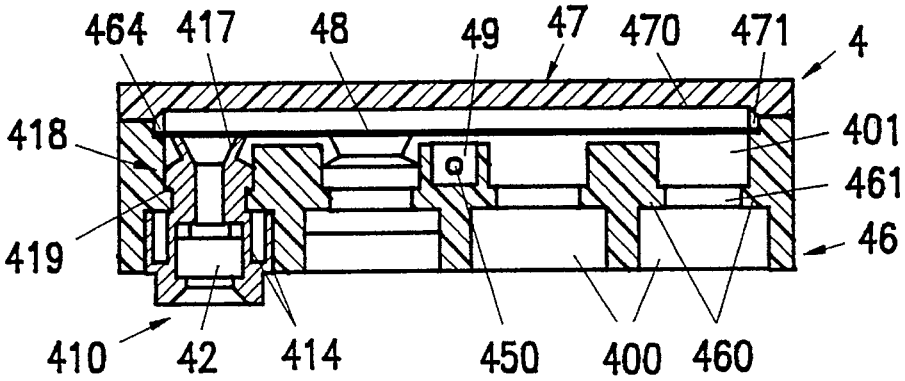
FIG. 16 is a horizontal cross-sectional view of the suction and cover cap according to FIG. 15 along section line 16—16.

FIG. 16 illustrates a cross-section through the suction and cover SC cap 4 according to FIG. 15 along a section line 16—16. The support part 46 of the suction and cover SC cap 4 is covered on the back side with a cover plate 47, where the cover plate 47 closes the chambers 401, 402, 403. The cover plate 47 exhibits a recess 470 along the section line 16—16, which recess 470 is covered with an oval-shaped sieve 48. The sieve 48 is disposed shape-matchingly in a recess 464 of the support part 46, and the sieve 48 is pressed by a protrusion 471 of the cover plate 47 during the assembly of the suction and cover SC cap 44 against the support part 46. The cover plate 47 is for example welded to the support part 46 during the mounting of the suction and cover SC cap 4. However, it is also possible to connect the cover plate 47 detachably with the support part 46. It has only to be assured in this context that no ink can escape from the suction and cover SC cap 4. The recess 470, together with the chambers 401 of the suction channels of the recesses 40 and with the sieve 48, forms a common withdrawal channel which exhibits the suction port 45 as an outlet. The sieve 48 serves during the insertion of the rubber insert 41 into the hollow space 40 as a stop for a funnel-shaped port or mouth 417, wherein the funnel-shaped port or mouth 417 is disposed at a burl-shaped extension 418 of the tub floor 412 in the region of the second passage opening 416. The passage opening 416 is extended up to the sieve 48 based on the burl-shaped extension 418 and the funnel-shaped port or mouth 417. The diameter of the funnel shaped part or mouth 417 at its widest open diameter can be from about 0.5 to one times the diameter of the liner 42. The diameter of the funnel shaped port or mouth 417 can be at its narrowest open diameter from about 0.1 to 0.5 and preferably from about 0.2 to 0.4 of the diameter of the liner 42. The total length of the rubber insert cap in flow direction can be from about 1 to 5 times the width of the liner 42 and is preferably from about 1.5 to 3 times the width of the liner 42.

The burl-shaped extension 418 exhibits a flange-like shaped projection 419 for the insertion of the rubber insert 41 into the hollow space 40, wherein the flange-like shaped projection 419 grips behind the separating wall 460 through a first bore hole 461 during the plugging through of the burl-shaped extension 418. The diameter of the flange-like shaped projection 419 can be from about 1.05 to 1.3 and is preferably from about 1.1 to 1.2 times the diameter of the rubber insert section at a section neighboring in front of the flange-like shaped projection. The total length of the burl-shaped extension 418 and of the funnel-shaped port 417 is dimensioned such that the suctioned ink jet fluid, passing through the passage opening 416, passes from the nozzle ejection openings only in the region of the funnel-shaped port 417 via the sieve 48 into the recess 470.

Two additional burl-shaped extensions 418 with the flange-like shaped projection 419 are disposed in the region of the first passage opening 415 and in the center of the tub floor 412 below the tub floor 412, wherein the flange-like shaped projection 419 grips also behind the separating wall 460 upon plugging through the burl-shaped extension 418 through a second bore 462 or, respectively, through a third bore 463. The burl-shaped extension 418 is formed in the region of the first passage opening 415 such that the passage opening 415 joins into the fourth chamber 403. The rubber insert 41 is attached uniformly in the support part 46 by the burl-shaped extension 418 in the center of the tub floor 412. This is associated with the advantage that the rubber insert 41, docked at the ink jet print unit 8, is not lifted out from the first chamber 400 upon suctioning the ink in the region between the two passage openings 415, 416.

The different color ink fluids passing in this way from the suction and cover SC cap 4 via the rubber insert cap 41, disposed in the hollow spaces 40, into the recess 470 are suctioned via the sieve 48 and a catch basin 49, disposed in the support part 46, through a discharge port 450 of the discharge port 45 into the discharge container 54, wherein the discharge port 450 joins into the catch basin 49. The catch basin 49 is preferably disposed in the center of the support part 46 between two neighboring chambers 401 of the suction channels of the recesses 40. A penetration of ink or, respectively, ink mixtures into neighboring suction channels or, respectively, the recesses 40 of the suction channels is prevented by the funnel-shaped ports 417, resting at the sieve filter 48, during the suctioning of the ink through the suction channels and the recess 470.

Figure 17:
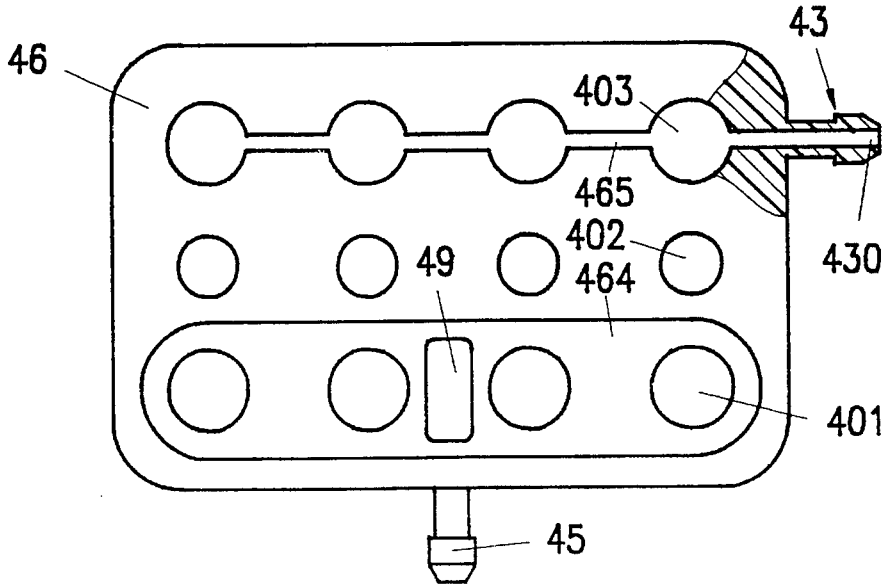
FIG. 17 is a rear elevational view of a construction of a support part of a suction and cover cap.

FIG. 17 illustrates a back view of the support part 46 welded to the cover plate 47. The catch basin 49 forms thereby a component of the channel system connected to the suction port 45 just as the chambers 401, the oval recess 464 for the sieve 48. The catch basin 49 is preferably disposed in the middle relative to the rubber insert cap position. The pressure compensation channels 403 of the suction and cover SC cap 4 are also connected to each other to form a pressure compensation channel system through a branch-channel-like trough 465, inserted into the support part 46, in order to be able to distribute the air from the ventilation valve 55 through the air hose 53 and an air channel 430 of the ventilation port 43 uniformly onto the pressure compensation channels 403 of the suction and cover SC cap 4. As described in conncection with the channel system for the suction port 45, the channel system of the ventilation port 43 is also closed by welding the cover plate 47 to the support part 46.

After the description of the detailed construction of the suction and cover SC cap 4, the functioning of the suction and cover SC cap 4 is as follows:

The suction and cover SC cap 4 is pressed with an opened ventilation valve 55 to the ink jet print unit 8 for the cleaning of the nozzle, ejection openings of the ink jet print heads 80, for example, for filling, flushing, and cleaning the ink jet print heads 80. The docking of the suction and cover SC cap 4 is required while the ventilation valve 55 is opened, because otherwise, the air would be pressed into the nozzle ejection openings during putting on the suction and cover SC cap 4 based on the generated press-on pressure. A pressing of air into the nozzle ejection openings would result in a destruction of the ink meniscus in the nozzle ejection openings. Air streaming into the nozzle ejection openings leads to a failure of the ink jet print device 1. The control of the ventilation valve 55 is performed in this context again by the control device in the ink jet print device 1.

The ventilation valve is closed after the suction and cover SC cap 4 has been docked at the ink jet print unit 8 and the pumping process is initiated by a reversal of the rotation direction of the cam disk 20. The ink is suctioned in this context with the aid of a negative pressure, generated by the closing of the ventilation valve 55, from the nozzle ejection openings of the ink jet print heads 80. The ink exiting from the nozzle ejection openings is initially received by the liner 42. If the liquid-absorbing liner is saturated with the ink, then the remaining ink passes via the second passage opening 416 of the rubber insert 41, the suction channel 401, and the sieve 48 into the catch basin 49, and then flows via the discharge port 450 of the suction port 45 as well as the hose 52 into the discharge container 54.

If the ink jet print heads 80 are sufficiently flushed and cleaned and subsequently filled, then the excessive ink remaining in the suction openings forming hollow spaces 40 still has to be suctioned. This is required for the reason because otherwise the ink, remaining and possibly dried in the hollow spaces or suction openings 40 or, respectively, the rubber insert caps 41, would again deposit at the nozzle ejection face 800 of the ink jet print unit and would clog the nozzle ejection face 800 upon renewed application of the suction and cover SC cap 4 to the ink jet print unit 8. In addition to suctioning the excessive ink from the hollow spaces or suction opening 40 of the suction and cover SC cap 4, the nozzle ejection face 800 of the ink-jet print unit 8 is regularly wiped after each flushing, cleaning, and filling process when the printer carriage moves out of the service and rest region according to FIG. 1, for the case that nevertheless ink is still depositing at the nozzle ejection face 800 of the ink jet print units and such that no print image disturbances can occur.

The suctioning of the excessive ink from the suction openings or, respectively, the hollow spaces 40 of the suction and cover SC cap 4 starts with the re-opening of the ventilation valve during the pumping process. The thereby suctioned air presses the ink out of the rubber insert 41 and out of the recesses or suction openings 40. The cross ribs 413, protruding into the rubber insert cap 41, are disposed on the tub floor 412 such that the ink between the liquid-absorbing liner 42 and the rubber insert cap 41 can flow off better through the second passage opening 416. The sieve 48 is of capillary construction in order to prevent in addition that the air passing through renders a further emptying of the neighboring other caps impossible upon emptying an individual cap 4. The capillarity of the sieve 48 is generated by providing that the sieve 48 exhibits a very fine-mesh sieve structure with very small holes for a total pressure in the suction and cover SC cap 4 of for example 400 mbar, where the small holes have for example in each case a diameter of 16 micrometers. The diameter for the sieve holes can be from about 4 to 40 micrometers and is preferably from about 10 to 20 micrometers. If the relative pressure applied at the sieve 48 is for example smaller than or equal to 50 mbar, then the air is blocked at the sieve 48. In order to be able to influence this blocking pressure at sieve 48, the discharge port 450 of the suction port 45 is dimensioned such that the discharge port 450 acts as a throttle for the ink suctioned from the ink jet print heads 80. Therefore, a typical diameter of the discharge port 450 amounts to for example 8/10 of a millimeter.

The pressure at the discharge port 450 has to be at least such that a difference pressure relative to the total pressure in the suction and cover SC cap 4 is smaller than the blocking pressure for the air at the sieve 48 for maintaining the blocking pressure. Given the predetermined blocking pressure of 50 mbar and the total pressure in the suction and cover SC cap 4 of 500 mbar, the pressure at the discharge port 450 has to be higher than 450 mbar. Since the pressure at the discharge port 450 is substantially determined by the flow rate of the ink, the pressure at the discharge port 450 changes as a function of the ink present in the suction and cover SC cap 4. The pressure drop at the discharge port 450, associated with a decreasing flow rate, is selected just such that, the difference pressure surpasses the predetermined blocking pressure for the sieve 48, upon a complete emptying of the hollow spaces 40 and of the rubber insers cap 41, and thereby the capillaries rip off in the sieve 48.

During larger print pause intervals of the ink jet print device 1, the suction and cover SC cap 4 is docked with an open ventilation valve at the ink jet print heads 80. The liner 42 saturated with the ink takes care during the print pause interval for a sufficient air humidity at the nozzle ejection openings of the ink jet print unit 8 such that an evaporation and drying of the ink is thereby prevented in the ink jet print heads 80.

Figure 18:
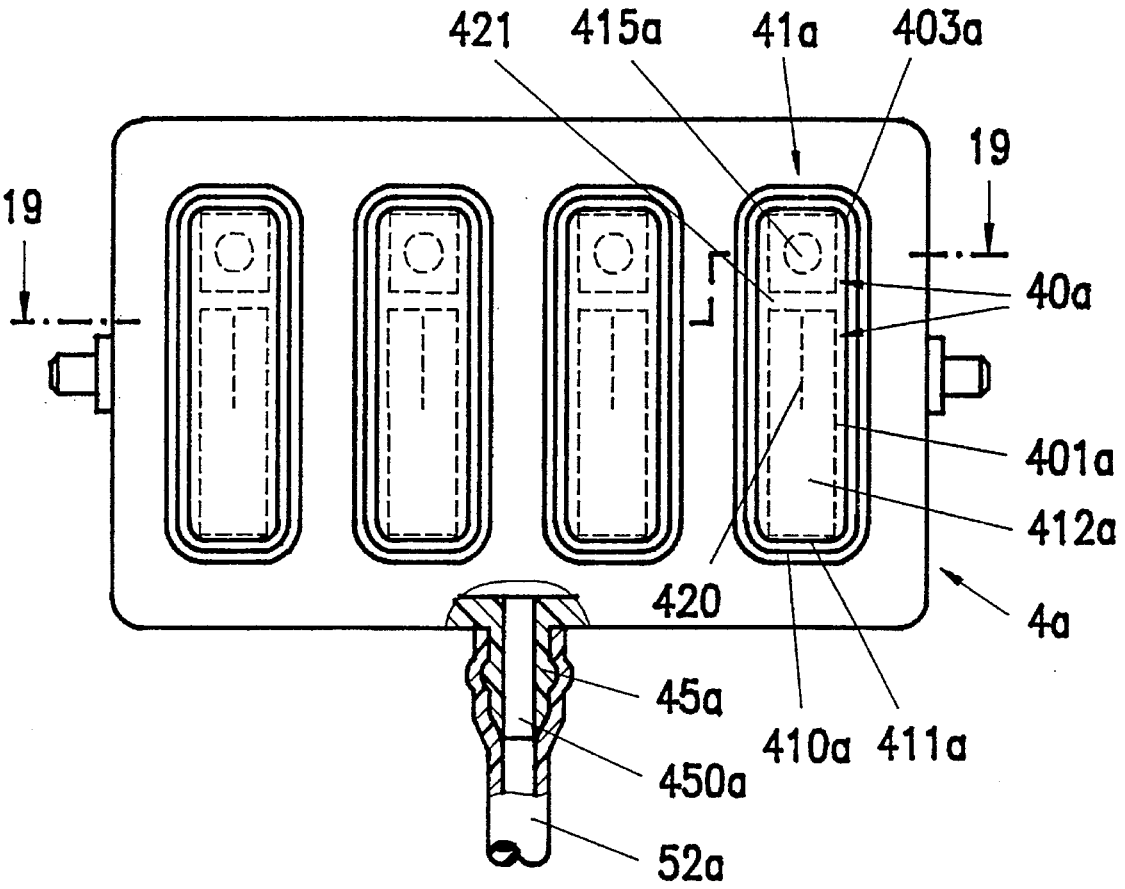
FIG. 18 a front elevational view of a second embodiment of a suction and cover cap corresponding to a respective detail in the upper right-hand corner of FIG. 2.

The detailed construction of a second embodiment of the suction and cover SC cap 4 with four tub-shaped rubber inserts **41*a*, integrated into a suction and cover SC cap 4*a* is shown in a top plan view of FIG. 18 for the separate suctioning of the ink from the nozzle ejection openings of the ink jet print heads 80. The suction and cover SC cap 4*a* can dispense with a controlled feeding of air via the ventilation valve and the ventilation port 43 in contrast to the suction and cover SC cap 4. Four equally sized double chambers 40*a*, disposed uniformly distributed on the suction and cover SC cap 4*a*, are characteristic for the construction of the suction and cover SC cap 4*a*, wherein the double chambers 40*a* are full face covered in each case by a tub floor 412*a* of the tub-shaped rubber insert cap 41*a*. The tub-shaped rubber insert 41*a* exhibits a sealing lip 410*a*, which surrounds a tub opening 411*a* of the rubber insert cap 41*a* and which is pressed against the ink jet print unit 8 during the docking of the suction and cover SC cap 4*a*, and which sealing lip thereby hermetically seals the nozzle ejection openings of the ink jet print heads 80. A fluid-absorbing liner 42*a* is placed in the tub-shaped rubber insert 41*a* through the tub opening 411*a* as occurred in connection with the suction and cover SC cap 4. The double chamber 40*a* comprises an ink chamber 401*a* and a pressure compensation chamber 403*a*. The ink chamber 401*a* is connected to a discharge port 450*a* of a suction port 45*a* through a channel system disposed in the suction and cover SC cap 4*a*. A hose 52*a* is again put on the suction port 54*a*, where the hose 52*a* transports the ink suctioned from the suction and cover SC cap 4*a* to the discharge container 54. A slot valve 420 is disposed in the tub floor 412*a* so that the ink suctioned from the ink jet print heads 80 can also pass from the tub-shaped rubber insert 41*a* into the ink chamber 401*a*. The slot valve 420 is realized for example by having single or multiple cuts made into the tub floor 412*a* formed as a membrane sheeting. If the suction and cover SC cap 4*a* is docked at the ink jet print unit 8 and if in the following ink is suctioned from the nozzle ejection openings of the ink jet print heads 80, then after the liner 42*a* is saturated with ink, the ink passes via the slot valve 420, opening in the suction direction, into the ink chamber 401*a* and from there through the discharge port 450*a* of the suction port 45*a* into the discharge container 54. A flowback of the ink, once having passed the slot valve 420, is no longer possible because the tabs of the slot valve 420 are prevented from flapping open in a direction opposite to the suction direction through the liner 42*a*. It is thereby prevented that undesirable color mixtures occur in the region of the tub-shaped rubber insert 41*a*** and, consequently, that print image disturbances occur during the subsequent printing process.

The pressure compensation chamber 403*a*, which is separated by an intermediate wall 421 from the ink chamber 401*a*, is connected to the rubber insert 41*a* through a passage opening 415*a* recessed into the tub floor 412*a*. An air overpressure, generated during the docking of the suction and cover SC cap 4*a* at the ink jet print unit 8, is balanced through the passage opening 415*a* such that the meniscus, generated through the capillary constructed ink jet print heads 80, is maintained at the nozzle ejection openings.

Figure 19:
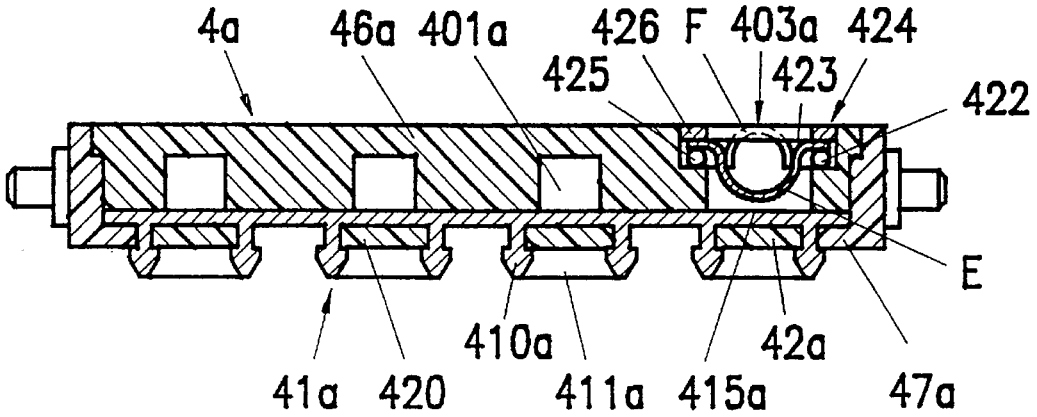
FIG. 19 is a horizontal cross-sectional view of the suction and cover cap according to FIG. 18 along section line 19—19.

FIG. 19 illustrates a section through the suction and cover SC cap 4*a* according to FIG. 18 along a section line 19—19. The suction and cover SC cap 4*a* is constructed according to FIG. 19 from the support part 46*a* and a covering 47*a*. The ink chamber 401*a* and the pressure balance chamber 403*a* are placed into the support part 46*a*. The pressure compensation chamber 403*a* completely penetrates the support part 46*a* while the ink chamber 401*a* is formed like a pocket hole. The pressure compensation chamber 403*a* is in part bored open on the side of the suction and cover SC cap 4*a* disposed opposite to the sealing lips 410*a*, whereby a stepping stage level structure 422 is generated. A hollow foil or film bubble 423 is clamped with the aid of a clamping device 424 in this stepping stage level structure 422, wherein the film bubble 423 operates as a pressure compensation membrane. The clamping device 424 comprises in this case an O-shaped ring 425 disposed in the stepping stage level structure 422, where the film bubble 423 is clamped with the aid of a punched disk 426 on the O-shaped ring 425. The film bubble 423, acting as a pressure compensation membrane, reacts to the changing air pressure conditions in the suction and cover SC cap 4*a* by increasing or, respectively, decreasing the volume in the suction and cover SC cap 4*a*. If the suction and cover SC cap 4*a* is for example docked to the ink jet print unit 8, then an overpressure is generated in the suction and cover SC cap 4*a* through which the film bubble 423, compensating the overpressure, passes from one state E into a state F. The adaptation of the film bubble 423 to the respective pressure conditions in the suction and cover SC cap 4*a* operates also in cases, where the suction and cover SC cap 4*a* is subjected to variations in temperature. In addition, the film bubble 423 is produced of a non-diffusing or, respectively, weakly diffusing material such that the nozzle ejection openings of the ink jet print heads 80 are in a most effective way protected against drying out, while the ink jet print device 1 is not in operation and the suction and cover SC cap 4*a* is docked at the ink jet print unit 8.

In addition, FIG. 19 shows how the tub-shaped rubber insert cap 41*a* is disposed above the ink chambers 401*a* recessed into the support part 46*a* and above the pressure compensation chamber 403*a* and thereby the tub-shaped rubber insert cap 41*a* is clamped between the support part 46*a* and the covering 47*a*. The covering 47*a* is for this purpose bored open in the periphery of the tub opening 411*a* of the rubber insert cap 41*a* and the covering 47*a* is put on over the support part 46*a* and the covering 47*a* is welded to the support part 46*a*.

Figures 20, 21, 22, 23, 24, 25, 26, 27, 28, 29:
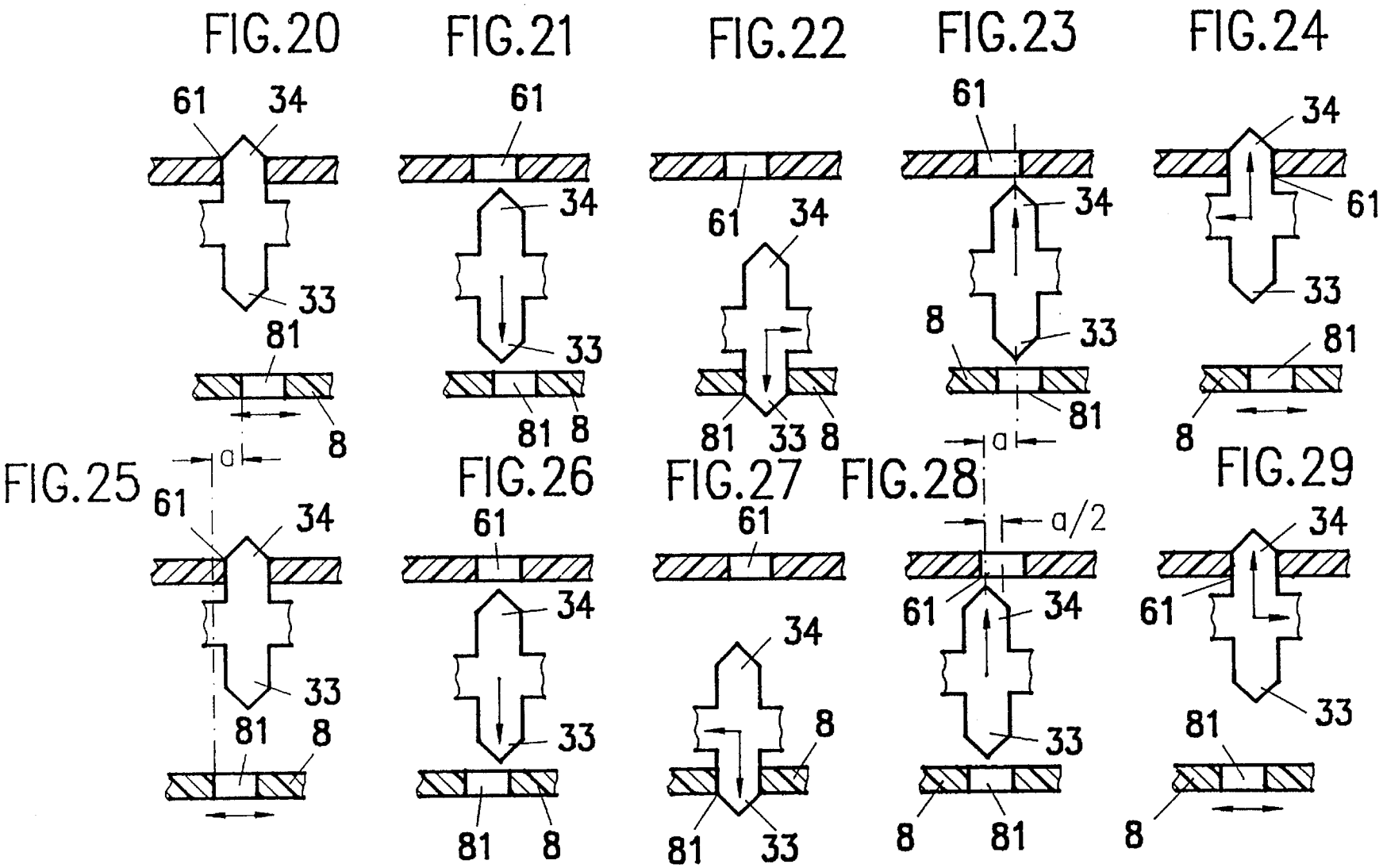
FIG. 20 illustrates a first position of a centering finger, of a suction and cover cap according to FIG. 2, for a first service position of an ink jet print unit.
FIG. 21 illustrates a second position of the centering finger of FIG. 20, of a suction and cover cap according to FIG. 2, for a first service position of an ink jet print unit.
FIG. 22 illustrates a third position of the centering finger of FIG. 20, of a suction and cover cap according to FIG. 2, for a first service position of an ink jet print unit.
FIG. 23 illustrates a fourth position of the centering finger of FIG. 20, of a suction and cover cap according to FIG. 2, for a first service position of an ink jet print unit.
FIG. 24 illustrates a fifth position of the centering finger of FIG. 20, corresponding to a return of said centering finger into said first position of the centering finger of FIG. 20, of a suction and cover cap according to FIG. 2, for a first service position of an ink jet print unit.
FIG. 25 illustrates a first position of a centering finger, of a suction and cover cap according to FIG. 2, for a second service position of an ink jet print unit.
FIG. 26 illustrates a second position of the centering finger of FIG. 25, of a suction and cover cap according to FIG. 2, for a second service position of an ink jet print unit.
FIG. 27 illustrates a third position of the centering finger of FIG. 25, of a suction and cover cap according to FIG. 2, for a third service position of an ink jet print unit.
FIG. 28 illustrates a fourth position of the centering finger of FIG. 25, of a suction and cover cap according to FIG. 2, for a second service position of an ink jet print unit.
FIG. 29 illustrates a fifth position of the centering finger of FIG. 25, corresponding to a return of said centering finger into said first position of the centering finger of FIG. 25, of a suction and cover cap according to FIG. 2, for a second service position of an ink jet print unit.

It is shown in FIGS. 20–29 how the suction and cover SC cap 4*a* according to FIG. 2, represented by the centering fingers 33, 34, is docked, for a first service position of the ink jet print unit 8 (FIGS. 20 to FIG. 24) and for a second service position of the ink jet print unit 8 (FIGS. 25 through 29), from the lifted-off state of the ink jet print unit 8 (FIGS. 20 and 25) at a precise position to the ink jet print unit 8 (FIG. 22 and FIG. 27), and how the suction and cover SA cap 4*a* returns again from the docked state also position-precise into the initial state (FIG. 24 and FIG. 29).

Substantial tolerances occur between the ink jet print unit 8 and the suction and cover SC cap 4 of the cleaning and sealing CS station 6 occur with the cleaning and sealing CS station 6, which is disposed stationary in the ink jet print device according to FIG. 1, where the tolerances interferingly oppose a precise and sealing docking on. The problem is made more critical, where no separate parking position is furnished for the cleaning and sealing CS station 6, but where the cleaning and sealing CS station 6 is disposed within the overshoot region OV of the printer carriage 7 carrying the ink jet print unit 8 resulting from the writing operation. The ink jet print unit 8 can come to rest at different positions within the overshoot region for the initially recited service treatments of the ink jet print unit 8 by the cleaning and sealing CS station 6. This means for the suction and cover SC cap 4 that before the docking onto the ink jet print unit 8 it has to track first into the position of the nozzle ejection openings of the ink jet print heads 80 in order to be able to perform the service treatments. This can be effected according to a first possible embodiment by the centering fingers 33, 34 according to FIGS. 20 to 29. The centering finger 33, 34 tapered at an acute angle is inserted for this purpose according to the FIGS. 22 and 27, as shown in FIG. 12, into the centering window 81 of the ink jet print unit 8. The printer carriage 7, carrying the ink jet print unit 8, can come to rest between an extreme right and an extreme left service position for the service treatment of the ink jet print unit 8.

In order to illustrate the problems during the docking of the suction and cover SC cap 4 to the ink jet print unit 8, the following considerations are presented.

If the printer carriage 7 comes to rest for a first service treatment of the ink jet print unit 8, for example, in its extreme left position, then the suction and cover SC cap 4 follows this position through the centering finger 33 inserted into the centering window 81 of the ink jet print unit 8 and docks at the ink jet print unit 8. If the first service treatment is terminated, then the suction and cover SC cap 4 is lifted from the ink jet print unit 8, returns into the original starting position, and thereby releases the ink jet print unit 8 for a renewed writing process. If the printer carriage 7 now comes to rest at its extreme right service position for a second service treatment of the ink jet print unit 8, then the suction and cover SC cap 4 has to be shifted by the total path distance between the extreme left and the extreme right service position of the printer carriage 7 in order to dock at the ink jet print unit 8. The same path distance has to be covered by the centering finger 33 in order to allow docking at a precise position. Since the centering fingers 33 are formed with an acute angle, a self-locking is avoided during the insertion of the centering finger 33 into the centering window 81 of the ink jet print unit 8. On the other hand, docking at a precise position of the suction and cover SC cap 4 at the ink jet print unit 8 can only then be preformed without additional steps with a centering finger 33, tapered at an acute angle, if a centering path a does not become too long for docking at a precise position of the suction and cover SC cap 4.

In order to address this problem, a second centering window 61 is furnished in the cleaning and sealing CS station 6 for the centering finger 34 according to FIGS. 20 through 29. The therewith associated centering on two sides of the suction and cover SC cap 4 has the consequence that the suction and cover SC cap 4 is docked always from a defined starting position at the ink jet print unit 8, even in case of extreme service positions of the printer carriage 7 for each service treatment, and upon lifting off returns again into this staring position. If the centering window 61 of the cleaning and sealing CS station 6 is disposed centered relative to a middle service position of the printer carriage 7, then the centering path a is also halved for the suction and cover SC cap 4 and the centering fingers 33, 34. Based on the by half shortened centering path a, the centering finger 33, 34 can again be formed with a more acute angle and the danger of a self-locking of the centering finger 33, 34 upon insertion into the first centering window 81 or, respectively, into the second centering window 61 can thereby be reduced. The self-locking occurs in particular in cases where both the centering finger 33, 34 as well as the first centering window 81 or, respectively, the second centering window 61 are made of plastic.

Figure 30:
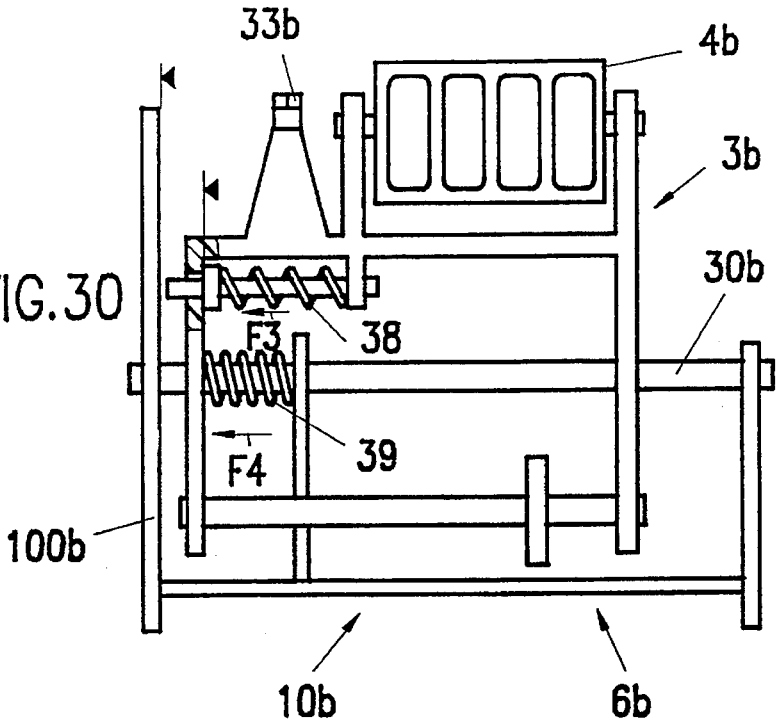
FIG. 30 illustrates a front elevational view of a second embodiment of docking a cleaning and sealing station at an ink jet print unit.

FIG. 30 illustrates starting from FIG. 2 by way of a second cleaning and sealing CS station 6*b*, a second possible embodiment how a suction and cover SC cap 4*b* can be precise-positionally docked at the ink jet print unit 8 for any arbitrary service position of the ink jet print unit 8, from a middle position, pretensioned by two springs 38, 39 with a spring force F3 or, respectively, F4 relative to a casing wall 100*b* of a support frame 10*b*. The casing wall 100 serves in this context, based on the highly precise mechanical milling and machining of the inner side, again as a reference edge both for the swivel lever 3*b*, laterally slidable on an axle 30*b* as well as for the printer carriage 7 supporting the ink jet print unit 8 and moving into a service position. If the printer carriage 7 comes to rest for different service treatments once at the extreme left and another time at the extreme right service position, then a centering finger 33*b*, disposed on the swivel lever 3*b*, can immerse into a third centering window 81*b* of the ink jet print unit 8, not illustrated in FIG. 30.

Figure 31:
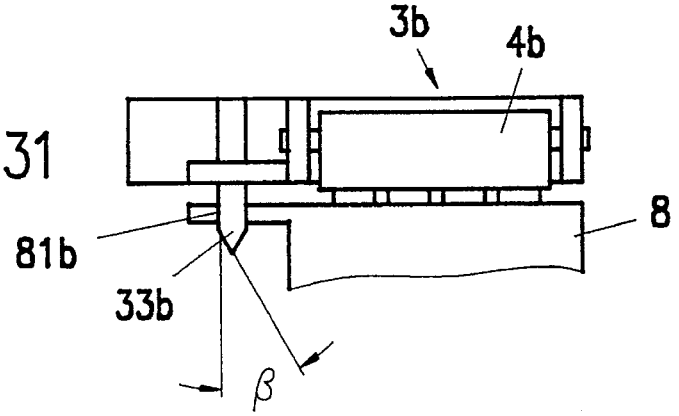
FIG. 31 illustrates a top plan view onto the cleaning and sealing station according to FIG. 30.

The immersing of the centering finger 33*b* into the centering window 81*b* is illustrated in FIG. 31 in a top plan view of the suction and cover SC cap 4*b* docked at the ink jet print unit 8. An angle beta, which indicates the acute angle structure of the end of the centering finger 33*b*, is smaller by half as compared to a suction and cover SC cap 4*b* without defined starting position, because the suction and cover SC cap 4*b* is docked at a precise position at the ink jet print unit 8 from the center position for each service treatment of the ink jet print unit 8.

Figure 32:
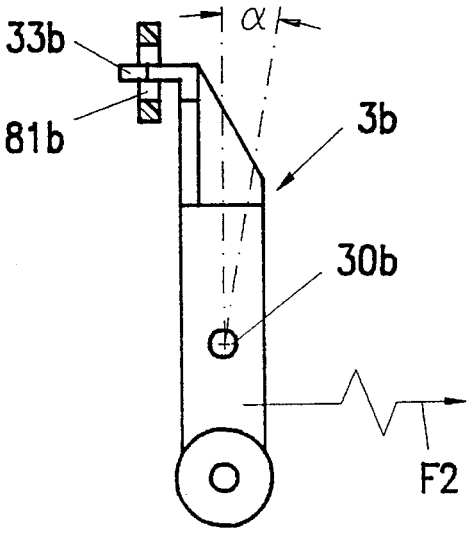
FIG. 32 illustrates a side elevational view of the cleaning and sealing station according to FIG. 30.

FIG. 32 illustrates a side elevational view of the cleaning and sealing CS station 6*b* according to FIG. 30. The swivel lever 3*b* is swivelled by a swivel angle alpha around the axle 30*b* in order to allow the centering finger 33*b* to immerse into the centering window 81*b* . The swivel angle alpha is fixedly determined by construction conditioned requirements of the cleaning and sealing CS station. For this purpose, the swivel angle alpha can also not be enlarged, in order to decrease the angle beta? and thereby to render the angle of the centering finger 33*b* more acute.

It will be understood that each of the elements described above, or two or more together, may also find a useful application in other types of ink printers differing from the types described above.

While the invention has been illustrated and described as embodied in the context of an ink printer with a cleaning and sealing station, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An ink jet print device comprising a print support platen receiving and supporting a recording substrate;

an ink jet print head disposed movable back and forth parallel to and along a longitudinal direction of the print support platen;

a cleaning and sealing station disposed in a work region for engaging the ink jet print head, and wherein the work region includes a printing region, a first overshoot region and a second overshoot region, wherein the first overshoot region and the second overshoot region are adjoining to the printing region, and wherein the first overshoot region and the second overshoot region allow for acceleration and deceleration of the ink jet print head, and wherein the cleaning and sealing station is disposed in one of the first overshoot region or the second overshoot region;

a support member attached swivelable toward the ink jet print head at the cleaning and sealing station;

a suction device disposed at the support member for suctioning ink from the ink jet print head;

a cover device disposed at the support member and covering the ink jet print head when the ink jet print head stays in a position facing the cover device, wherein the cover device together with the suction device form a covering and suctioning unit, and wherein the covering and suctioning unit comprises an elastic cap positionable against the ink jet print head, a pressure compensation channel connected to and coordinated to the cap for a pressure compensation in the cap and a suction channel coordinated to the cap for the withdrawal of the ink, and wherein the pressure compensation channel of the cap is coupled to a pressure compensation device, a common withdrawal channel, wherein the suction channel joins in the common withdrawal channel, wherein the common withdrawal channel is in connection with the suction device, and a valve device connected to and coordinated to the suction channel and exhibiting a capillary filter disposed in the suction channel, wherein a suction pressure generated by the suction device and acting at the common withdrawal channel is selected such that, upon emptying the suction channel of ink, the capillary filter is only then overcome by inflowing ambient air through the suction channel when the suction channel no longer contains any ink.

2. The ink jet print device according to claim 1, wherein the cleaning and sealing station is constructed as a self-contained construction unit capable of being exchanged by withdrawing from and inserting into the ink jet print device.

3. The ink jet print device according to claim 1, further comprising a pivot drive disposed at the cleaning and sealing station for the support member;

a pump coupled to the pivot drive for suctioning of the ink from the covering and suctioning unit.

4. The ink jet print device according to claim 3, further comprising an adjustment device attached to the support member, wherein the adjustment device furnishes the support member with adjustability of a position for setting a relative position of the support member with respect to the ink jet print head.

5. The ink jet print device according to claim 4, further comprising a printer carriage, wherein the printer carriage and the ink jet print head form an ink jet print unit, wherein the support member for the covering and suctioning unit is movably supported by means of the adjustment device between two lateral relative positions of the ink jet print unit relative to the suction device and to the cover device.

6. The ink jet print device according to claim 1, further comprising a motor-driven cam disk disposed on the cleaning and sealing station for tilting the support member;

spring support means for maintaining a support member spring supported and resting at the cam disk.

7. The ink jet print device according to claim 6, further comprising a running wheel coordinated to the support member, wherein the motor-driven cam disk includes two cam paths, wherein the two cam paths are joining each other, and wherein the running wheel is guided on the cam paths.

8. The ink jet print device according to claim 7, further comprising a printer carriage, wherein the printer carriage and the ink jet print head form an ink jet print unit, a switch tongue coordinated to and actuated by the cam disk, wherein the switch tongue initiates a suctioning of the ink from the covering and suctioning unit or, respectively, a decoupling of the covering and suctioning unit from the ink jet print unit based on controlling a circumferential path of the running wheel guided on the cam paths disposed around the cam disk as a function of the direction of rotation of the motor-driven cam disk for the suction device and the cover device coupled to the ink jet print unit.

9. The ink jet print device according to claim 1, wherein the covering and suctioning unit is furnished with an elastically formed cap with a liquid-absorbing liner for hermetically sealing the ink jet print head during the suctioning of the ink from the ink jet print head and for covering the ink jet print head.

10. The ink jet print device according to claim 1, wherein the pressure compensation device exhibits a common ventilation channel coupled to the pressure compensation channel, where the common ventilation channel has a controllable closure for the feeding of air as required depending on the operating position of the suction and cover device.

11. The ink jet print device according to claim 1, wherein the valve device coordinated to the suction channel exhibits a one-way directional valve, wherein the one-way directional valve is opening in suction direction of the ink and closing in opposite direction to the suction direction of the ink.

12. The ink jet print device according to claim 1, wherein the suction device and the cover device further comprises:

a second elastic rubber insert cap provided to be resting at a second ink jet print head, and wherein the number of rubber insert caps corresponds to the number of ink jet print heads;

a second pressure compensation channel coordinated to and connected to the second rubber insert cap for furnishing a pressure compensation in the second rubber insert cap, wherein the pressure compensation device is coupled and connected to the second pressure compensation channel of the second rubber insert cap;

a second suction channel coordinated to and connected to the second rubber insert cap for allowing a withdrawal of ink, and wherein the common withdrawal channel is connected to the suction channel.

13. The suction and covering device according to claim 12, further comprising a second liner of a fluid-absorbing material disposed in the second rubber insert cap, wherein the second rubber insert cap has a tub shape;

a second elastically formed sealing lip, wherein the second elastically formed sealing lip surrounds a second tub-shaped floor of the second rubber insert cap, and wherein the second elastically formed sealing lip hermetically seals the second ink jet print head upon pressing-on of the second rubber insert cap onto the ink jet print unit;

a second web included in the second elastically formed sealing lip surrounding the second tub floor of the second rubber insert cap, wherein the second web is constructed like lamellas based on cross ribs, and wherein the second elastically formed sealing lip limits a rubber insert cap opening, and wherein the second sealing lip is disposed on the second web;

wherein the second elastically formed sealing lip provides a second lock stop for the second fluid-absorbing liner, and wherein the second elastically formed sealing lip is constructed for securing the second fluid-absorbing liner disposed in the second rubber insert cap against falling out;

a second burl-shaped extension disposed at the second rubber insert cap, wherein the second burl-shaped extension is disposed at a second floor of the second rubber insert cap, and wherein the second burl-shaped extension serves for an attachment of the second rubber insert cap in the single form part;

wherein the second burl-shaped extension, disposed at the floor of the rubber insert cap, receives one of the pressure compensation channel and the suction channel.

14. An ink jet print device comprising a print support platen receiving and supporting a recording substrate;

an ink jet print head disposed movable back and forth parallel to and along a longitudinal direction of the print support platen;

a cleaning and sealing station disposed in a work region for engaging the ink jet print head, and wherein the work region includes a printing region, a first overshoot region and a second overshoot region, wherein the first overshoot region and the second overshoot region are adjoining to the printing region, and wherein the first overshoot region and the second overshoot region allow for acceleration and deceleration of the ink jet print head, and wherein the cleaning and sealing station is disposed in one of the first overshoot region or the second overshoot region;

a suction device for suctioning ink from the ink jet print head;

a cover device for covering the ink jet print head wherein the cover device together with the suction device form a covering and suctioning unit;

a support member for supporting the covering and suctioning unit and disposed at the cleaning and sealing station, wherein the support member is constructed and attached at the cleaning and sealing station swivelable toward the ink jet print head, and wherein the covering and suctioning unit comprises an elastic cap positionable against the ink jet print head, a pressure compensation channel connected to and coordinated to the cap for a pressure compensation in the cap and a suction channel coordinated to the cap for the withdrawal of the ink, and wherein the pressure compensation channel of the cap is coupled to a pressure compensation device, a common withdrawal channel, wherein the suction channel joins in the common withdrawal channel, wherein the common withdrawal channel is in connection with the suction device, and a valve device connected to and coordinated to the suction channel for assuring a controlled withdrawal of ink from the cap, and wherein the pressure compensation device is formed as a closed system relative to the ambient air, with a common pressure compensation chamber for the pressure compensation channel and a membrane film for closing the pressure compensation chamber relative to the ambient air.

15. The ink jet print device according to claim 14, wherein the cleaning and sealing station is constructed as a self-contained construction unit capable of being exchanged by withdrawing from and inserting into the ink jet print device.

16. The ink jet print device according to claim 14, further comprising an adjustment device attached to the support member, wherein the adjustment device furnishes the support member with adjustability of a position for setting a relative position of the support member with respect to the ink jet print head.

17. The ink jet print device according to claim 14, further comprising a motor-driven cam disk disposed on the cleaning and sealing station for tilting the support member;

spring support means for maintaining a support member spring supported and resting at the cam disk.

18. The ink jet print device according to claim 14, further comprising a pivot drive disposed at the cleaning and sealing station for the support member;

a pump coupled to the pivot drive for suctioning of the ink from the covering and suctioning unit.

19. The ink jet print device according to claim 14, wherein the pressure compensation device exhibits a common ventilation channel coupled to the pressure compensation channel, where the common ventilation channel has a controllable closure for the feeding of air as required depending on the operating position of the suction and cover device.

20. The ink jet print device according to claim 14, wherein the valve device coordinated to the suction channel exhibits a one-way directional valve, wherein the one-way directional valve is opening in suction direction of the ink and closing in opposite direction to the suction direction of the ink.

21. The ink jet print device according to claim 14, wherein the suction device and the cover device further comprise:

a second elastic rubber insert cap provided to be resting at a second ink jet print head, and wherein the number of rubber insert caps corresponds to the number of ink jet print heads;

a second pressure compensation channel coordinated to and connected to the second rubber insert cap for furnishing a pressure compensation in the second rubber insert cap, wherein the pressure compensation device is coupled and connected to the second pressure compensation channel of the second rubber insert cap;

a second suction channel coordinated to and connected to the second rubber insert cap for allowing a withdrawal of ink, and wherein the common withdrawal channel is connected to the suction channel.

22. An ink jet print device comprising a print support platen receiving and supporting a recording substrate;

a printer carriage movable back and forth parallel to and along a longitudinal direction of the print support platen;

a plurality of ink jet print heads disposed on the printer carriage and forming with the printer carriage an ink jet print unit;

a cleaning and sealing station disposed in a work region for engaging the ink jet print head, and wherein the work region includes a printing region, a first overshoot region and a second overshoot region, wherein the first overshoot region and the second overshoot region are adjoining to the printing region, and wherein the first overshoot region and the second overshoot region allow for acceleration and deceleration of the ink jet print unit, and wherein the cleaning and sealing station is disposed in one of the first overshoot region or the second overshoot region, and wherein the cleaning and sealing station is a self-contained construction unit capable of being exchanged by withdrawing from and inserting into the ink jet print device, wherein the cleaning and sealing station comprises a swivel lever support, a plurality of tub-shaped elastic insert caps forming a suction and cover cap device, a plurality of liquid-absorbing liners, wherein each of the plurality of liquid-absorbing liners is supported by a respective one of the plurality of tub-shaped elastic insert caps, wherein the swivel lever support movably supports the suction and cover cap device, wherein the plurality of tub-shaped elastic insert caps are of a number equal to the plurality of ink jet print heads, and wherein the swivel lever support with the suction and cover cap device is tiltable toward the ink jet print unit, a plurality of pressure compensation channels, wherein each of the plurality of pressure compensation channels is coordinated to one of the plurality of tub-shaped elastic insert caps, and wherein the plurality of pressure compensation channels in each case includes a fourth chamber, a first passage opening, and a third opening bore, a plurality of suction channels, wherein each of the plurality of suction channels is coordinated to one of the plurality of tub-shaped elastic insert caps for a withdrawal of ink, and wherein the plurality of suction channels includes in each case a first chamber and a second chamber, a pressure compensation device, wherein the plurality of the pressure compensation channels, including in each case the fourth chamber, the first passage opening, and the third opening bore, are coupled to the pressure compensation device, a common withdrawal channel, wherein the common withdrawal channel is connected to the first chamber and the second chamber of the suction channels, a suction device formed by a bellows and connected to the common withdrawal device, a valve device, wherein one valve device is coordinated to each one of the plurality of suction channels, for a controlled withdrawal of ink from each one of the plurality of tub-shaped elastic insert caps, and wherein the valve device includes a sieve and a slot valve.

23. The ink jet print device according to claim 22, wherein the sieve of the valve device is coordinated to the suction channels including the second chamber and the first chamber, wherein the sieve is formed by a capillary filter disposed in one respective suction channel of the plurality of suction channels, and wherein a suction pressure, acting at the withdrawal channel including a suction port, the catch basin, and an oval-shaped recess, is selected such that the capillary filter is only overcome and passed through by inflowing ambient air through the suction channels, including the second chamber and the first chamber, when all suction channels are empty of ink.

24. The ink jet print device according to claim 22, wherein the slot valve of the valve device is formed as a one-way directional valve, wherein the one-way directional valve opens in a suction direction of the ink and closes in a direction opposite to the suction direction of the ink.

25. The ink jet print device according to claim 22, wherein the swivel lever support is a positioning device for positioning the cleaning and sealing station with the plurality of tub-shaped elastic insert caps at a relative position to the plurality of ink jet print heads, and wherein the swivel lever support includes a first centering finger and a second centering finger and wherein the swivel lever support is spring tensioned.

26. The ink jet print device according to claim 22, further comprising a common ventilation channel, wherein the common ventilation channel is coupled to the pressure compensation channels, and wherein the common ventilation channel includes a trough and an air channel;

a controllable closure furnished by the ventilation valve and disposed at the common ventilation channel, wherein said controllable closure is provided for feeding in an amount of air as required depending on an operation position of the suction and cover cap device.

27. The ink jet print device according to claim 22, further comprising a membrane film formed by a film bubble;

wherein a pressure compensation device is formed as a closed system relative to ambient air, and wherein one common pressure compensation chamber is provided for the pressure compensation channels including the fourth chamber and the trough, and wherein the membrane film formed by the film bubble closes said common pressure compensation chamber relative to ambient air.

28. An ink jet print device with the following features:

a) at least one ink jet print head (80) is disposed movable back and forth in a work region (OP) along a print support platen (9) and a cleaning and sealing station (6), wherein the print support platen receives a recording substrate, b) the work region (OP) exhibits a printing region (PR) and overshoot regions (OV), wherein the overshoot regions adjoin at the printing region (PR) and serve for accelerating and braking a back and forth movable ink jet print head (8), and c) the cleaning and sealing station (6) is disposed in an overshoot region (OV)

wherein the cleaning and sealing station (6) exhibits a support (3, 3*b*) for a suction and cover device (4, 4*a*, 4*b*) for suctioning ink from the ink jet print heads (80) and covering the ink jet print heads (80), wherein the support (3, 3*b*) is constructed swivelable toward the ink jet print heads (80), wherein the suction and cover device (4, 4*a*, 4*b*) exhibits a plurality of elastically formed caps (41, 41*a*) with a respective plurality of liquid-absorbing liners (42, 42*a*) for hermetically sealing the ink jet print heads (80) during the suctioning of the ink from the ink jet print heads (80), wherein the elastic caps (41, 41*a*) are positionable against the ink jet print heads (80) and wherein a number of the elastic caps (41, 41*a*) corresponds to the number of the ink jet print heads (80) and a plurality of pressure compensation channels, wherein each pressure compensation channel (403, 415, 463) is coordinated to one respective cap of the plurality of caps (41, 41*a*) for a pressure compensation in the cap, and wherein each of a plurality of suction channels (401, 400) is coordinated to one of the plurality of caps for the withdrawal of the ink, wherein a plurality of pressure compensation channels (403, 415, 463) connected to the plurality of caps (41, 41*a*) is coupled to a pressure compensation device (43, 55, 403*a*, 423), wherein the plurality of suction channels (401, 400) join into a common withdrawal channel (49, 470), wherein the common withdrawal channel (49, 470) is connected to a suction device (51), and wherein a plurality of valve devices (48, 420) is provided, with each valve device (48, 420) coordinated and connected to each one of the plurality of suction channels (401, 400) for a controlled withdrawal of ink from each one of the plurality of caps (41, 41*a*), wherein the pressure compensation device exhibits a common ventilation channel (465, 430), coupled to the plurality of pressure compensation channels, where the common ventilation channel has a controllable closure (55) for the feeding of air as required depending on the operating position of the suction and cover device wherein the support (3, 3*b*) includes an adjustment device (33, 34, 33*b*, F3, F4), wherein the adjustment device (33, 34, 33*b*, F3, F4) allows positioning the support (3, 3*b*) with respect to the relative position of the support (3, 3*b*) to the ink jet print heads (80), wherein the suction device and for the covering device (4, 4*a*, 4*b*) are movably supported by means of the support (3, 3*b*) between two lateral relative positions of the ink jet print unit (8) with respect to the suction and cover device (4, 4*a*, 4*b*), wherein a motor-driven cam disk (20) is furnished for the tilting of the support (3, 3*b*), where the support (3, 3*b*) is spring-supportably resting at the motor-driven cam disk (20), wherein a pivot drive (30) for the support (3, 3*b*) is coupled with a pump (5) for the suctioning of the ink from the suction and cover device (4, 4*a*, 4*b*), wherein the motor-driven cam disk (20) exhibits two cam paths (201, 202), which cam paths (201, 202) are joining each other, wherein a running wheel (21), coordinated to the support (3, 3*b*) is guided on the cam paths (201, 202), wherein the plurality of valve devices, coordinated to the plurality of suction channels (401, 400), includes a plurality of capillary filters (48) disposed in one respective suction channel of the plurality of suction channels, wherein a suction pressure acting at the withdrawal channel (45, 49, 464) is selected such that, upon emptying the plurality of suction channels of ink, the capillary filter (48) is only then overcome by the inflowing ambient air through the plurality of suction channels (400, 401) when the plurality of suction channels no longer contains any ink.

29. The ink jet print device according to claim 28, wherein the cleaning and sealing station (6) is constructed as an autonomous construction unit which can be exchangeably inserted into the ink jet print device.

30. The ink jet print device according to claim 28, wherein the pressure compensation device is formed as a closed system relative to the ambient air, with a common pressure compensation chamber (403*a*) for the plurality of pressure compensation channels (403, 465) and a membrane film (423), closing the pressure compensation chamber (403*a*) relative to the ambient air.

31. The ink jet print device according to claim 28, wherein a switch tongue (203) engages matchingly the cam disk (20), wherein the switch tongue (203) initiates a suctioning of the ink or, respectively, a decoupling of the suction and cover cap (4, 4*a*, 4*b*) from the ink jet print unit (8) based on controlling the circumferential path of the running wheel (21) around the cam disk (20) as a function of the direction of rotation of the motor-driven cam disk (20) for the suction and cover cap (4, 4*a*, 4*b*) coupled to the ink jet print unit (8).

32. An ink jet print device with the following features:

a) at least one ink jet print head (80) is disposed movable back and forth in a work region (OP) along a print support platen (9) and a cleaning and sealing station (6), wherein the print support platen receives a recording substrate, b) the work region (OP) exhibits a printing region (PR) and overshoot regions (OV), wherein the overshoot regions adjoin at the printing region (PR) and serve for accelerating and braking a back and forth movable ink jet print head (8), and c) the cleaning and sealing station (6) is disposed in an overshoot region (OV)

wherein the cleaning and sealing station (6) exhibits a support (3, 3*b*) for a suction and cover device (4, 4*a*, 4*b*), wherein the support (3, 3*b*) is constructed swivelable toward the ink jet print heads (80) for suctioning ink from the ink jet print heads (80) and covering the ink jet print heads (80), wherein the support (3, 3*b*) includes an adjustment device (33, 34, 33*b*, F3, F4), wherein the adjustment device (33, 34, 33*b*, F3, F4) allows positioning the support (3, 3*b*) with respect to the relative position of the support (3, 3*b*) to the ink jet print heads (80), wherein the support member for the suction device and for the covering device (4, 4*a*, 4*b*) is movably supported by means of the positioning device (3, 3*b*) between two lateral relative positions of the ink jet print unit (8) with respect to the suction and cover device (4, 4*a*, 4*b*), wherein a motor-driven cam disk (20) is furnished for the tilting of the support (3, 3*b*), where the support (3, 3*b*) is spring supportably resting at the cam disk (20), wherein a pivot drive (30) for the support (3, 3*b*) is coupled with a pump (5) for the suctioning of the ink from the suction and cover device (4, 4*a*, 4*b*), wherein the motor-driven cam disk (20) exhibits two cam paths (201, 202), which cam paths (201, 202) are joining each other, wherein a running wheel (21), coordinated to the support (3, 3*b*) is guided on the cam paths (201, 202) wherein the suction and cover device (4, 4*a*, 4*b*) exhibits a plurality of elastically formed caps (41, 41*a*) with a respective plurality of liquid-absorbing liners (42, 42*a*) for hermetically sealing the ink jet print heads (80) during the suctioning of the ink from the ink jet print heads (80) and for covering the ink jet print heads (80), wherein the suction and cover device (4, 4*a*, 4*b*) exhibits a plurality of elastically formed caps (41, 41*a*) with a respective plurality of liquid-absorbing liners (42, 42*a*) for hermetically sealing the ink jet print heads (80) during the suctioning of the ink from the ink jet print heads (80) and for covering the ink jet print heads (80), wherein a suction and cover device (4, 4*a*, 4*b*) comprises elastic caps (41, 41*a*) positionable against the ink jet print heads (80) corresponding to the number the ink jet print heads (80), a plurality of pressure compensation channels, wherein each pressure compensation channel (403, 415, 463) is coordinated to one respective cap of the plurality of caps (41, 41*a*) for a pressure compensation in the cap, and wherein each of a plurality of suction channels (401, 400) is coordinated to one of the plurality of caps for the withdrawal of the ink, wherein a plurality of pressure compensation channels (403, 415, 463) for and connected to the plurality of caps (41, 41*a*) is coupled to a pressure compensation device (43, 55, 403*a*, 423), wherein the plurality of suction channels (401, 400) join into a common withdrawal channel (49, 470), wherein the common withdrawal channel (49, 470) is connected to a suction device (51), and wherein a plurality of valve devices (48, 420) is provided, with each valve device (48, 420) coordinated and connected to each one of the plurality of suction channels (401, 400) for a controlled withdrawal of ink from each one of the plurality of caps (41, 41*a*), wherein the pressure compensation device exhibits a common ventilation channel (465, 430), coupled to the plurality of pressure compensation channels, where the common ventilation channel has a controllable closure (55) for the feeding of air as required depending on the operating position of the suction and cover device, wherein the pressure compensation device is formed as a closed system relative to the ambient air, with a common pressure compensation chamber (403*a*) for the plurality of pressure compensation channels (403, 465) and a membrane film (423), closing the pressure compensation chamber (403*a*) relative to the ambient air, wherein the plurality of valve devices, coordinated and connected to the plurality of suction channels (400, 401) includes a plurality of one-way directional valves (420), wherein each one of the plurality of one-way directional valves (420) is opening in suction direction of the ink and closing in an opposite direction relative to the suction direction of the ink.

33. An ink jet print device with the following features:

a) at least one ink jet print head (80) is disposed movable back and forth in a work region (OP) along a print support platen (9) and a cleaning and sealing station (6), wherein the print support platen receives a recording substrate, b) the work region (OP) exhibits a printing region (PR) and overshoot regions (OV), wherein the overshoot regions adjoin at the printing region (PR) and serve for accelerating and braking a back and forth movable ink jet print head (8), and c) the cleaning and sealing station (6) is disposed in an overshoot region (OV)

wherein the cleaning and sealing station (6) exhibits a support (3, 3*b*) for a suction and cover device (4, 4*a*, 4*b*), wherein the support (3, 3*b*) is constructed swivelable toward the ink jet print heads (80), wherein the support (3, 3*b*) includes an adjustment device (33, 34, 33*b*, F3, F4), wherein the adjustment device (33, 34, 33*b*, F3, F4) allows positioning the support (3, 3*b*) with respect to the relative position of the support (3, 3*b*) to the ink jet print heads (80), wherein the suction device and the covering device (4, 4*a*, 4*b*) are movably supported by means of the support (3, 3*b*) between two lateral relative positions of the ink jet print unit (8) with respect to the suction and cover device (4, 4*a*, 4*b*), wherein a motor-driven cam disk (20) is furnished for the tilting of the support (3, 3*b*), where the support (3, 3*b*) is spring-supportably resting at the cam disk (20), wherein a pivot drive (30) for the support (3, 3*b*) is coupled with a pump (5) for the suctioning of the ink from the suction and cover device (4, 4*a*, 4*b*), wherein the motor-driven cam disk (20) exhibits two cam paths (201, 202), which cam paths (201, 202) are joining each other, wherein a running wheel (21), coordinated to the support (3, 3*b*) is guided on the cam paths (201, 202)

wherein the suction and cover device (4, 4*a*, 4*b*) exhibits a plurality of elastically formed caps (41, 41*a*) with a respective plurality of liquid-absorbing liners (42, 42*a*) for hermetically sealing the ink jet print heads (80) during the suctioning of the ink from the ink jet print heads (80) and for covering the ink jet print heads (80), wherein the suction and cover device (4, 4*a*, 4*b*) exhibits a plurality of elastically formed caps (41, 41*a*) with a respective plurality of liquid-absorbing liners (42, 42*a*) for hermetically sealing the ink jet print heads (80) during the suctioning of the ink from the ink jet print heads (80) and for covering the ink jet print heads (80), wherein a suction and cover device (4, 4*a*, 4*b*) comprises elastic caps (41, 41*a*) positionable against the ink jet print heads (80) corresponding to the number the ink jet print heads (80), a plurality of pressure compensation channels, wherein each pressure compensation channel (403, 415, 463) is coordinated to one respective cap of the plurality of caps (41, 41*a*) for a pressure compensation in the cap, and wherein each of a plurality of suction channels (401, 400) is coordinated to one of the plurality of caps for the withdrawal of the ink, wherein a plurality of pressure compensation channels (403, 415, 463) for and connected to the plurality of caps (41, 41*a*) is coupled to a pressure compensation device (43, 55, 403*a*, 423), wherein the plurality of suction channels (401, 400) join into a common withdrawal channel (49, 470), wherein the common withdrawal channel (49, 470) is connected to a suction device (51), and wherein a plurality of valve devices (48, 420) is provided, with each valve device (48, 420) coordinated and connected to each one of the plurality of suction channels (401, 400) for a controlled withdrawal of ink from each one of the plurality of caps (41, 41*a*), wherein the pressure compensation device exhibits a common ventilation channel (465, 430), coupled to the plurality of pressure compensation channels, where the common ventilation channel has a controllable closure (55) for the feeding of air as required depending on the operating position of the suction and cover device, wherein the pressure compensation device is formed as a closed system relative to the ambient air, with a common pressure compensation chamber (403*a*) for the plurality of pressure compensation channels (403, 465) and a membrane film (423), closing the pressure compensation chamber (403*a*) relative to the ambient air, wherein the plurality of valve devices, coordinated and connected to the plurality of suction channels (400, 401) includes a plurality of one-way directional valves (420), wherein each one of the plurality of one-way directional valves (420) is opening in suction direction of the ink and closing in an opposite direction relative to the suction direction of the ink.

34. An ink jet print device with the following features:

a) at least one ink jet print head (80) is disposed movable back and forth in a work region (OP) along a print support platen (9) and a cleaning and sealing station (6), wherein the print support platen receives a recording substrate, b) the work region (OP) exhibits a printing region (PR) and overshoot regions (OV), wherein the overshoot regions adjoin at the printing region (PR) and serve for accelerating and braking a back and forth movable ink jet print head (8), and c) the cleaning and sealing station (6) is disposed in an overshoot region (OV), wherein the cleaning and sealing station (6) exhibits a support (3, 3*b*) for a suction and cover device (4, 4*a*, 4*b*), wherein the support (3, 3*b*) is constructed swivelable toward the ink jet print heads (80) for suctioning ink from the ink jet print heads (80) and covering the ink jet print heads (80), wherein the support (3, 3*b*) includes an adjustment device (33, 34, 33*b*, F3, F4), wherein the adjustment device (33, 34, 33*b*, F3, F4) allows positioning the support (3, 3*b*) with respect to the relative position of the support (3, 3*b*) to the ink jet print heads (80), wherein the support member for the suction device and for the covering device (4, 4*a*, 4*b*) is movably supported by means of the support (3, 3*b*) between two lateral relative positions of the ink jet print unit (8) with respect to the suction and cover device (4, 4*a*, 4*b*), wherein a motor-driven cam disk (20) is furnished for the tilting of the support (3, 3*b*), where the support (3, 3*b*) is spring-supportably resting at the cam disk (20), wherein a pivot drive (30) for the support (3, 3*b*) is coupled with a pump (5) for the suctioning of the ink from the suction and cover device (4, 4*a*, 4*b*), wherein the motor-driven cam disk (20) exhibits two cam paths (201, 202), which cam paths (201, 202) are joining each other, wherein a running wheel (21), coordinated to the support (3, 3*b*) is guided on the cam paths (201, 202)

wherein the suction and cover device (4, 4*a*, 4*b*) exhibits a plurality of elastically formed caps (41, 41*a*) with a respective plurality of liquid-absorbing liners (42, 42*a*) for hermetically sealing the ink jet print heads (80) during the suctioning of the ink from the ink jet print heads (80) and for covering the ink jet print heads (80), wherein the suction and cover device (4, 4*a*, 4*b*) exhibits a plurality of elastically formed caps (41, 41*a*) with a respective plurality of liquid-absorbing liners (42, 42*a*) for hermetically sealing the ink jet print heads (80) during the suctioning of the ink from the ink jet print heads (80) and for covering the ink jet print heads (80), wherein a suction and cover device (4, 4*a*, 4*b*) comprises elastic caps (41, 41*a*) positionable against the ink jet print heads (80) corresponding to the number the ink jet print heads (80), a plurality of pressure compensation channels, wherein each pressure compensation channel (403, 415, 463) is coordinated to one respective cap of the plurality of caps (41, 41*a*) for a pressure compensation in the cap, and wherein each of a plurality of suction channels (401, 400) is coordinated to one of the plurality of caps for the withdrawal of the ink, wherein a plurality of pressure compensation channels (403, 415, 463) for and connected to the plurality of caps (41, 41*a*) is coupled to a pressure compensation device (43, 55, 403*a*, 423), wherein the plurality of suction channels (401, 400) join into a common withdrawal channel (49, 470), wherein the common withdrawal channel (49, 470) is connected to a suction device (51), and wherein a plurality of valve devices (48, 420) is provided, with each valve device (48, 420) coordinated and connected to each one of the plurality of suction channels (401, 400) for a controlled withdrawal of ink from each one of the plurality of caps (41, 41*a*), wherein the pressure compensation device exhibits a common ventilation channel (465, 430), coupled to the plurality of pressure compensation channels, where the common ventilation channel has a controllable closure (55) for the feeding of air as required depending on the operating position of the suction and cover device, wherein the pressure compensation device is formed as a closed system relative to the ambient air, with a common pressure compensation chamber (403*a*) for the plurality of pressure compensation channels (403, 465) and a membrane film (423), closing the pressure compensation chamber (403*a*) relative to the ambient air, wherein the pressure compensation device is formed as a closed system relative to the ambient air, with a common pressure compensation chamber (403*a*) for the plurality of pressure compensation channels (403, 465) and a membrane film (423), closing the pressure compensation chamber (403*a*) relative to the ambient air.

* * * * *